US009339697B2

(12) United States Patent
Luciano, Jr. et al.

(10) Patent No.: US 9,339,697 B2
(45) Date of Patent: May 17, 2016

(54) RFID GOLF BALL TARGET SYSTEM AND METHOD

(75) Inventors: Robert A. Luciano, Jr., Reno, NV (US); Warren White, Reno, NV (US); David Grieshaber, Brisbane, CA (US)

(73) Assignee: EDGE TECHNOLOGY, Reno, NV (US)

( * ) Notice: Subject to any disclaimer, the term of this patent is extended or adjusted under 35 U.S.C. 154(b) by 0 days.

(21) Appl. No.: 13/277,940

(22) Filed: Oct. 20, 2011

(65) Prior Publication Data

US 2012/0052967 A1 Mar. 1, 2012

Related U.S. Application Data

(63) Continuation-in-part of application No. 13/212,850, filed on Aug. 18, 2011, now Pat. No. 8,866,613, and a continuation-in-part of application No. 13/212,885, filed on Aug. 18, 2011, now Pat. No. 9,035,749.

(60) Provisional application No. 61/374,713, filed on Aug. 18, 2010, provisional application No. 61/375,555, filed on Aug. 20, 2010.

(51) Int. Cl.
*G08B 13/14* (2006.01)
*G07C 1/24* (2006.01)
(Continued)

(52) U.S. Cl.
CPC ..... *A63B 43/00* (2013.01); *A63B 37/0003* (2013.01); *A63B 45/00* (2013.01); *A63B 63/00* (2013.01); *A63B 69/3694* (2013.01); *A63B 2024/004* (2013.01); *A63B 2024/0037* (2013.01); *A63B 2071/025* (2013.01); *A63B 2220/10* (2013.01); *A63B 2220/12* (2013.01); *A63B 2225/15* (2013.01); *A63B 2225/54* (2013.01)

(58) Field of Classification Search
CPC ..... G08B 13/14
USPC ..... 340/572.1
See application file for complete search history.

(56) References Cited

U.S. PATENT DOCUMENTS 3,369,812 A 2/1968 McKee
3,828,353 A 8/1974 Majkrzak et al.
(Continued)

FOREIGN PATENT DOCUMENTS

GB 2446212 A 6/2006
JP 8224331 9/1996
JP 2013154176 A 8/2013

*Primary Examiner* — Jennifer Mehmood
*Assistant Examiner* — John Mortell
(74) *Attorney, Agent, or Firm* — Michael A. Kerr; Kerr IP Group, LLC

(57) ABSTRACT

A radio-frequency identification (RFID) golf ball range target system is described. The RFID golf ball range target system includes a RFID golf ball, a scanner, a client computer, a game selection module, a target, a target RFID reader and a target network communications module. The RFID golf ball that includes a RFID tag fixedly coupled to the surface of a spherical golf ball core corresponding to the RFID golf ball, wherein the RFID tag is disposed between the spherical golf ball core and a spherical golf ball shell. A unique RFID golf ball identifier is associated with the RFID golf ball. In the illustrative embodiment, the RFID tag includes an omnidirectional antenna that operates in the ultra-high-frequency (UHF) range. Additionally, the illustrative RFID tag can be encapsulated in a flexible substrate that is disposed between the spherical golf ball core and a spherical golf ball shell.

19 Claims, 19 Drawing Sheets

(51) Int. Cl.

| | |
|---|---|
| ***A63B 67/02*** | (2006.01) |
| ***A63B 43/00*** | (2006.01) |
| ***A63F 7/20*** | (2006.01) |
| ***A63B 71/00*** | (2006.01) |
| ***A63F 9/24*** | (2006.01) |
| ***A63B 37/00*** | (2006.01) |
| ***A63B 45/00*** | (2006.01) |
| ***A63B 63/00*** | (2006.01) |
| *A63B 69/36* | (2006.01) |
| *A63B 24/00* | (2006.01) |
| *A63B 71/02* | (2006.01) |

(56) References Cited

U.S. PATENT DOCUMENTS

| | | | | |
|---|---|---|---|---|
| 3,889,957 | A | 6/1975 | Klabacka | |
| 4,816,836 | A | 3/1989 | Lalezari | |
| 4,979,739 | A | 12/1990 | Allen et al. | |
| 5,102,140 | A | 4/1992 | Vincent | |
| 5,114,155 | A | 5/1992 | Tillery et al. | |
| 5,370,389 | A | 12/1994 | Reising | |
| 5,439,224 | A | 8/1995 | Bertoncino | |
| 5,505,457 | A | 4/1996 | Boylan et al. | |
| 5,513,841 | A | 5/1996 | Takagi | |
| 5,516,841 | A | 5/1996 | Takagi | |
| 5,626,531 | A | 5/1997 | Little | |
| 5,674,130 | A | 10/1997 | Egan | |
| 5,743,815 | A * | 4/1998 | Helderman | A63B 37/0003 473/152 |
| 5,821,525 | A | 10/1998 | Takebayashi | |
| 5,910,057 | A | 6/1999 | Quimby et al. | |
| 5,948,679 | A | 9/1999 | Born et al. | |
| 5,949,679 | A | 9/1999 | Born et al. | |
| 6,148,271 | A | 11/2000 | Marinelli | |
| 6,322,455 | B1 | 11/2001 | Howey | |
| 6,569,028 | B1 | 5/2003 | Nichols et al. | |
| 6,607,123 | B1 | 8/2003 | Jollifee et al. | |
| 6,620,057 | B1 * | 9/2003 | Pirritano | A63B 24/0021 342/51 |
| 6,705,942 | B1 | 3/2004 | Crook et al. | |
| 6,974,391 | B2 * | 12/2005 | Ainsworth | A63B 24/0006 473/153 |
| 6,998,965 | B1 * | 2/2006 | Luciano, Jr. | A63B 24/0021 235/375 |
| 7,040,998 | B2 | 5/2006 | Jolliffe et al. | |
| 7,052,391 | B1 | 5/2006 | Luciano, Jr. | |
| 7,056,221 | B2 | 6/2006 | Thirkettle et al. | |
| 7,059,974 | B1 | 6/2006 | Golliffe et al. | |
| 7,118,105 | B2 | 10/2006 | Benevento | |
| 7,160,196 | B2 | 1/2007 | Thirkettle et al. | |
| 7,315,253 | B1 | 1/2008 | Pijanowski et al. | |
| 7,337,965 | B2 | 3/2008 | Thirkettle et al. | |
| 7,540,428 | B2 | 6/2009 | Baba et al. | |
| 7,691,009 | B2 * | 4/2010 | Savarese | A63B 24/0021 473/152 |
| 7,714,965 | B2 | 5/2010 | Chien et al. | |
| 7,766,766 | B2 | 8/2010 | Savarese et al. | |
| 7,791,982 | B2 | 9/2010 | Karr | |
| 7,843,334 | B2 | 11/2010 | Kumagai et al. | |
| 8,120,540 | B1 | 2/2012 | Armstrong | |
| 8,866,613 | B2 | 10/2014 | Luciano, Jr. | |
| 8,882,606 | B2 | 11/2014 | Leech et al. | |
| 2002/0065567 | A1 | 5/2002 | Kodera | |
| 2003/0004005 | A1 | 1/2003 | Ainsworth et al. | |
| 2003/0085619 | A1 | 5/2003 | Strache et al. | |
| 2003/0191547 | A1 | 10/2003 | Morse | |
| 2004/0142766 | A1 | 7/2004 | Savarese et al. | |
| 2004/0214648 | A1 | 10/2004 | Simpson | |
| 2004/0243262 | A1 | 12/2004 | Hofmann | |
| 2005/0051951 | A1 * | 3/2005 | Benevento | A63B 67/02 273/120 R |
| 2005/0070376 | A1 | 3/2005 | Savarese et al. | |
| 2005/0227792 | A1 * | 10/2005 | McCreary | A63B 24/0003 473/409 |
| 2005/0272496 | A1 | 12/2005 | Reinish et al. | |
| 2005/0282650 | A1 | 12/2005 | Miettinen et al. | |
| 2006/0105857 | A1 | 5/2006 | Stark | |
| 2006/0122007 | A1 | 6/2006 | Savarese et al. | |
| 2007/0026968 | A1 | 2/2007 | Ratcliffe | |
| 2007/0026986 | A1 | 2/2007 | Ratcliffe | |
| 2007/0167247 | A1 | 7/2007 | Lindsay | |
| 2007/0259740 | A1 | 11/2007 | Savarese et al. | |
| 2008/0000364 | A1 | 1/2008 | Bevirt | |
| 2008/0021651 | A1 | 1/2008 | Seeley et al. | |
| 2008/0158072 | A1 | 7/2008 | Logan et al. | |
| 2008/0207357 | A1 | 8/2008 | Savarese et al. | |
| 2009/0017944 | A1 | 1/2009 | Savarese et al. | |
| 2009/0052618 | A1 | 2/2009 | Homanfar et al. | |
| 2009/0253526 | A1 | 10/2009 | Koudele et al. | |
| 2010/0201512 | A1 | 8/2010 | Stirling et al. | |
| 2010/0304876 | A1 | 12/2010 | Hohla et al. | |
| 2010/0328038 | A1 | 12/2010 | Kato | |
| 2011/0201437 | A1 | 8/2011 | Fallow et al. | |
| 2012/0052967 | A1 | 3/2012 | Grieshaber et al. | |
| 2012/0096358 | A1 | 4/2012 | Barnes, Jr. | |
| 2012/0205452 | A1 | 8/2012 | Rofougaran | |
| 2012/0208638 | A1 | 8/2012 | Rofougaran | |
| 2012/0255999 | A1 | 10/2012 | Luciano | |
| 2012/0256731 | A1 | 10/2012 | Luciano et al. | |
| 2013/0023210 | A1 | 1/2013 | Rofougaran | |
| 2013/0154176 | A1 | 6/2013 | Oshima | |
| 2013/0165261 | A1 | 6/2013 | Luciano et al. | |
| 2013/0196787 | A1 | 8/2013 | Luciano et al. | |
| 2013/0196788 | A1 | 8/2013 | Shimizu et al. | |

* cited by examiner

RFID GOLF BALL TARGET SYSTEM AND METHOD

CROSS REFERENCE

This patent application is a continuation-in-part of utility patent application Ser. No. 13/212,850 filed on Aug. 18, 2011 and entitled BALL SEPARATION DEVICE FOR A GOLF RANGE TARGET and is a continuation-in-part of utility patent application Ser. No. 13/212,885 filed on Aug. 18, 2011 and entitled MOVABLE GOLF RANGE TARGET WITH RFID BALL IDENTIFIER; and both patent applications claim the benefit of provisional patent application 61/374,713 filed on Aug. 18, 2010 and entitled MOVABLE GOLF RANGE TARGET WITH RFID BALL IDENTIFIER and claims benefit of provisional patent application 61/375,555 filed on Aug. 20, 2010 and entitled BALL SEPARATION DEVICE FOR A GOLF RANGE TARGET.

FIELD

The present invention relates to an radio-frequency identification (RFID) golf ball target system and method for identifying golf balls. More particularly, the invention is related to a golf ball target system and method that identifies golf balls in games of skill, games of chance and any combination thereof.

BACKGROUND

A golf driving range lets golfers practice their golf swing. Generally, a golf driving range is adjacent to a golf course and a player purchases a bucket of golf balls that are then hit at targets in the golf driving range. The balls may be stored in buckets or dispensed into a bucket from a hopper. The player takes the balls to the tee area. The golf driving range has various markers for distance placed throughout the range. A player hits the ball and makes a visual estimate of the distance the ball traveled based on the landing location of the ball relative to the distance markers. Players would benefit from a system capable of accurately determining the distance of ball travel.

RFID transponders embedded in golf balls have been used to allow a player to detect the distance of travel of a golf ball. For example, a player may use a handheld reader to detect the location of a golf ball after it is hit. However, some players may not wish to be burdened with a handheld reader during play.

Although golf balls having RFID transponders have been used in conjunction with ball collectors capable of reading the transponders to determine the distance traveled by a golf ball hit onto a driving range, it would be beneficial to provide a movable target which can be repositioned to provide flexibility in the arrangement of a golf range, in which the movable target includes a nested funnel configuration.

Additionally, driving ranges that employ RFID chip technology are limited by not supporting game selection modules that include games of chance or the combinations of games of skill and games of chance.

SUMMARY

A radio-frequency identification (RFID) golf ball range target system is described. The RFID golf ball range target system includes a RFID golf ball, a golf driving booth, a scanner, a client computer, a game selection module, a golf ball dispenser, an issuing area RFID reader, a target having a target capture area, a target RFID reader and a target network communications module.

The RFID golf ball that includes a RFID tag fixedly coupled to the surface of a spherical golf ball core corresponding to the RFID golf ball, wherein the RFID tag is disposed between the spherical golf ball core and a spherical golf ball shell. A unique RFID golf ball identifier is associated with the RFID golf ball. In the illustrative embodiment, the RFID tag includes an omnidirectional antenna that operates in the ultra-high-frequency (UHF) range. Additionally, the illustrative RFID tag can be encapsulated in a flexible substrate that is disposed between the spherical golf ball core and a spherical golf ball shell.

The golf driving range booth includes a scanner configured to scan an electronic device having a player ID that is associated with a particular player. The golf driving range booth also includes a client computer having an illustrative touch screen display that presents player information associated with the player ID. The game selection module is presented on the client computer and allows the player to select from a variety of different games.

The golf driving range also includes the golf ball dispenser that houses the RFID golf balls. The issuing area RFID reader associated with the golf dispenser reads the RFID golf balls that are associated with the player ID. The issuing area RFID reader is also communicatively coupled to the issuing area network communications module.

The player hits the RFID golf ball to the target having a known geographic location. The target includes an enclosed boundary capture component, a target RFID reader, and a target network communications module. The enclosed boundary capture component is configured to receive at least one RFID golf ball in a capture area. The target RFID reader is associated with the capture area and is configured to read the RFID golf ball. The target network communications module communicates a plurality of reads associated with the target RFID reader reading a plurality of RFID golf balls.

In the illustrative embodiment, the RFID golf ball range target system includes a touch screen display and a second display that also presents the player information associated with the player ID.

The RFID golf ball range target system also includes a server communicatively coupled to the issuing area network communications module, the target area network communications module, the first scanner, the client computer and the game selection module. The server database includes an association between a plurality of RFID golf balls and the player ID, a RFID golf ball identification from the target RFID reader, and the geographic location of the movable target.

In another embodiment, the game selection module includes at least one game of skill, in which an award is provided when the RFID golf ball associated with the player ID is read by the target RFID reader that is associated with the capture area. By way of example and not of limitation, the award may be a predetermined number of points based on the distance and size of the capture area.

In an alternative embodiment, the game selection modules includes at least one game of chance, in which a game session for the game of chance is initiated when the RFID golf ball associated with the player ID is read by the target RFID reader, a random result for the game session is generated, and a paytable associates a prize with the random game session result. The awarded prize is then displayed to the player.

In another embodiment, the game selection module includes a game that has both a first game of skill component and a second game of chance. The embodiment starts with the player, by way of example and not of limitation, hitting the ball in the target area and getting points, and a subsequent game of chance, i.e. spinning a wheel for additional points. In operation, a first award is initially provided when the RFID golf ball is received by the capture area. This first award is based on the player's skill in hitting the ball at the appropriate target. The player then has the opportunity to play a second game of chance. By way of example and not of limitation, the second game may be referred to as a bonus game, in which the bonus game is a game of chance where the player gets to spin a wheel. The random prize corresponding to the spinning wheel is then awarded to the player. Alternative games of chance include reels in a slot machine, virtual scratcher, bingo card, lottery game or other such graphic representation of a game of chance.

In another game embodiment, after a predetermined number of misses by the player, e.g. after 20 balls have been hit but none landed in the target area, the game session for the game of chance is initiated. Therefore, the player can continue to play the game and win points, even if he/she lacks the skill necessary to hit the golf ball into the target.

A method for operating a radio-frequency identification (RFID) golf ball range target system is also described. The method includes scanning an electronic device having a player ID that is associated with a particular player. The method then proceeds to present player information associated with a player ID to a client computer. The player can then select a game on the client computer from a variety of different games.

The next step in the method for operating a RFID golf ball range target system includes dispensing RFID golf balls and enabling an issuing area RFID reader to read the RFID golf ball. In the illustrative embodiment, the RFID tag is fixedly coupled to the surface of a spherical golf ball core corresponding to the RFID golf ball. The illustrative RFID tag is an omnidirectional tag disposed between the spherical golf ball core and a spherical golf ball shell that are associated with the player ID. The issuing area RFID reader is communicatively coupled to an issuing area network communications module.

The player then proceeds to hit the RFID golf ball at a target having a known geographic location. The target includes an enclosed boundary capture component configured to receive at least one RFID golf ball in a capture area. The captured RFID golf ball is then read by a target RFID reader that communicates the RFID golf ball data via a target network communications module.

In a game of skill embodiment, the game selection module includes at least one game of skill, in which an award is provided when the RFID golf ball associated with the player ID is read by the target RFID reader that is associated with the capture area.

In a game of chance embodiment, a game session for the game of chance is initiated when the RFID golf ball associated with the player ID is read by the target RFID reader. After the game of change is initiated, a random result for the game session is generated and a paytable associates a prize according to the random game session result.

FIGURES

The illustrative embodiment will be more fully understood by reference to the following drawings which are for illustrative, not limiting, purposes.

Figure 6A:
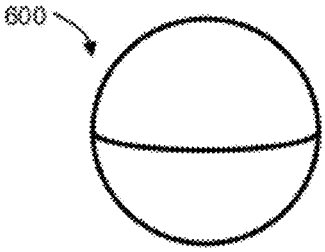
Figure 6B:
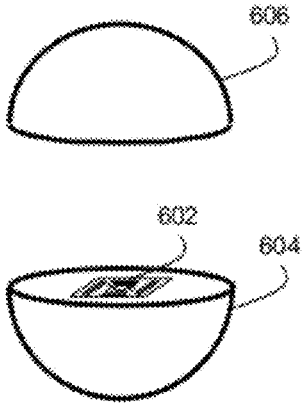
Figure 6C:
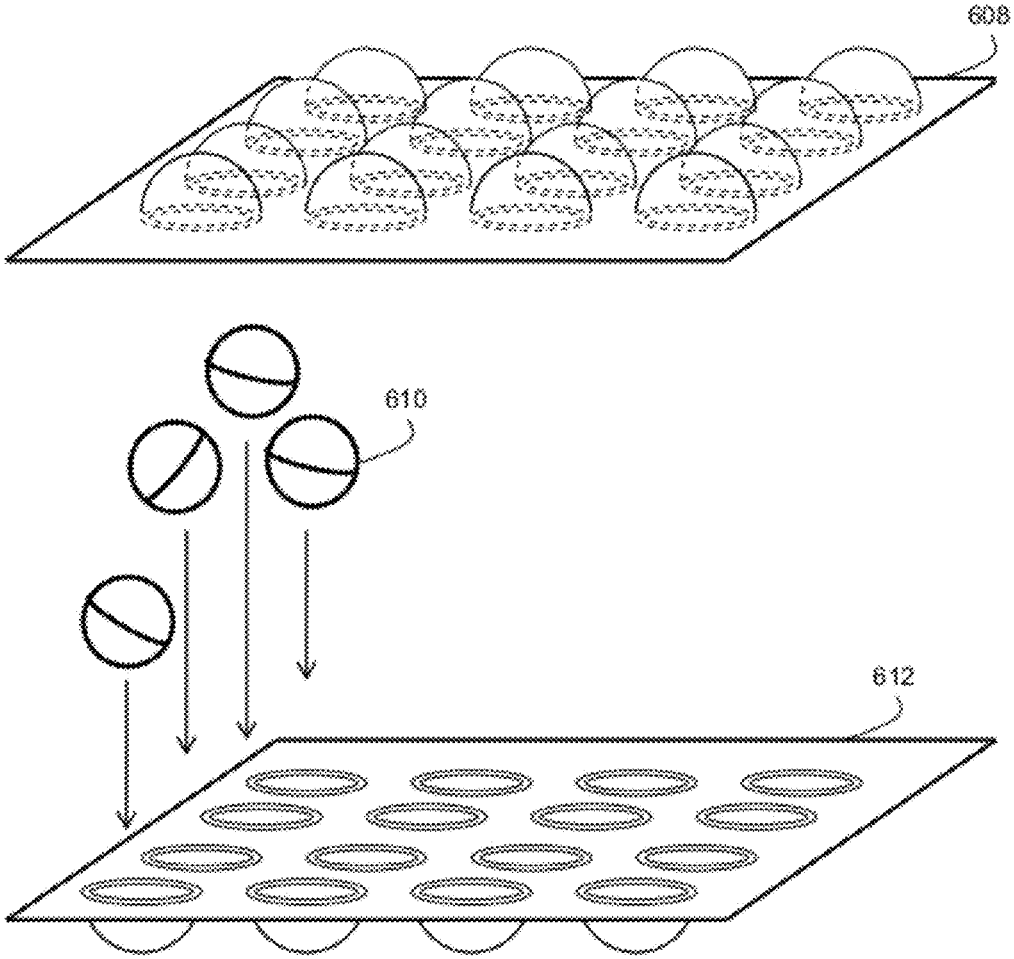

FIGS. 6A-C show various states of manufacture of the illustrative 2D RFID golf ball.

Figure 7:
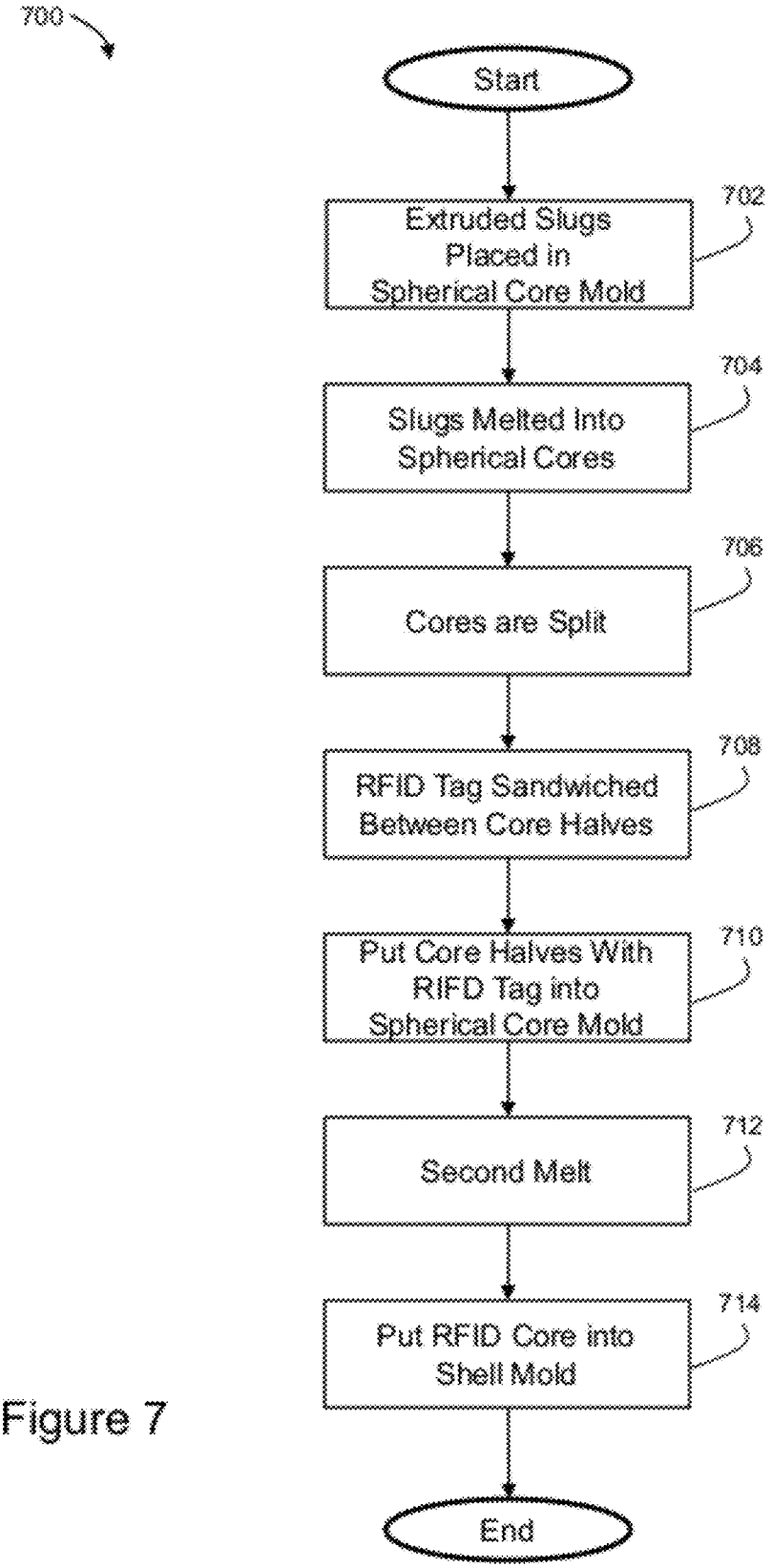

FIG. 7 shows an illustrative method for fabricating a 2D RFID golf ball.

Figure 8A:
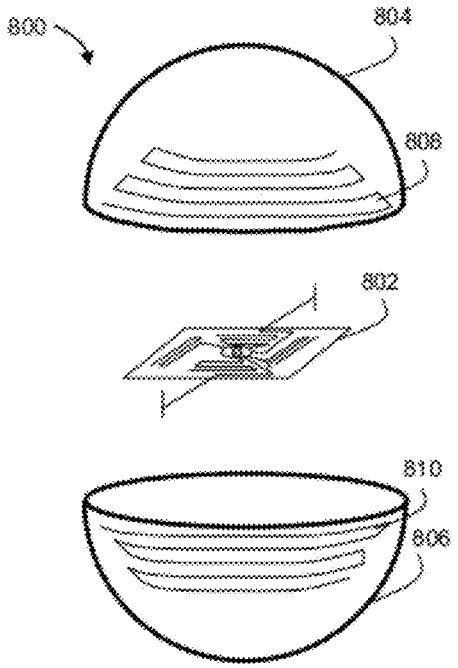
Figure 8B:
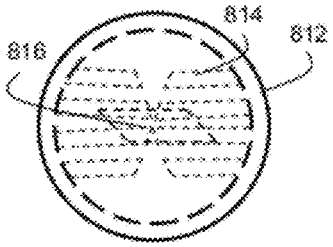
Figure 8C:
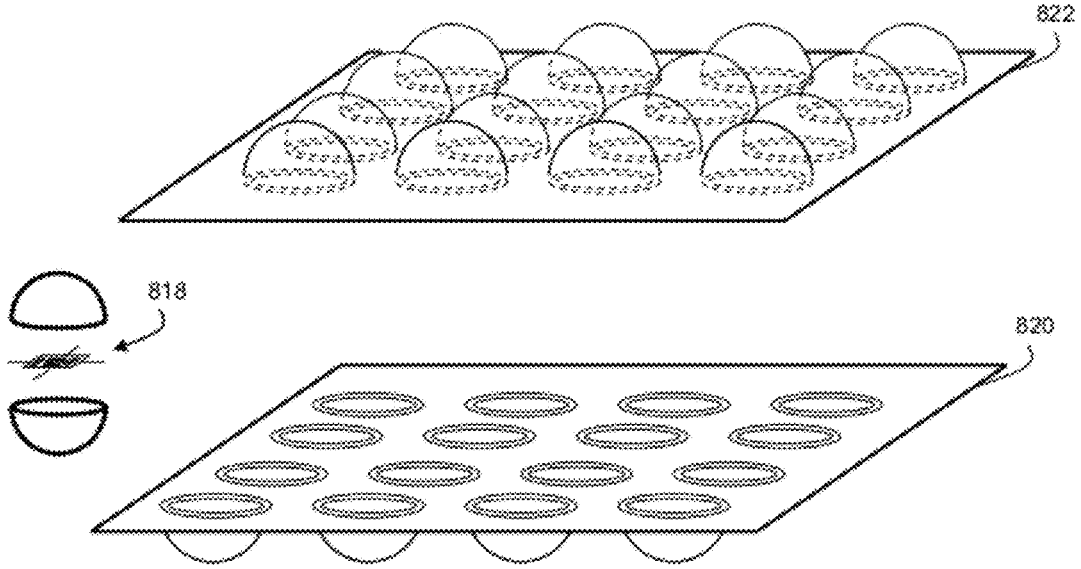

FIGS. 8A-C show various states of manufacture of the illustrative omnidirectional RFID golf ball.

Figure 9A:
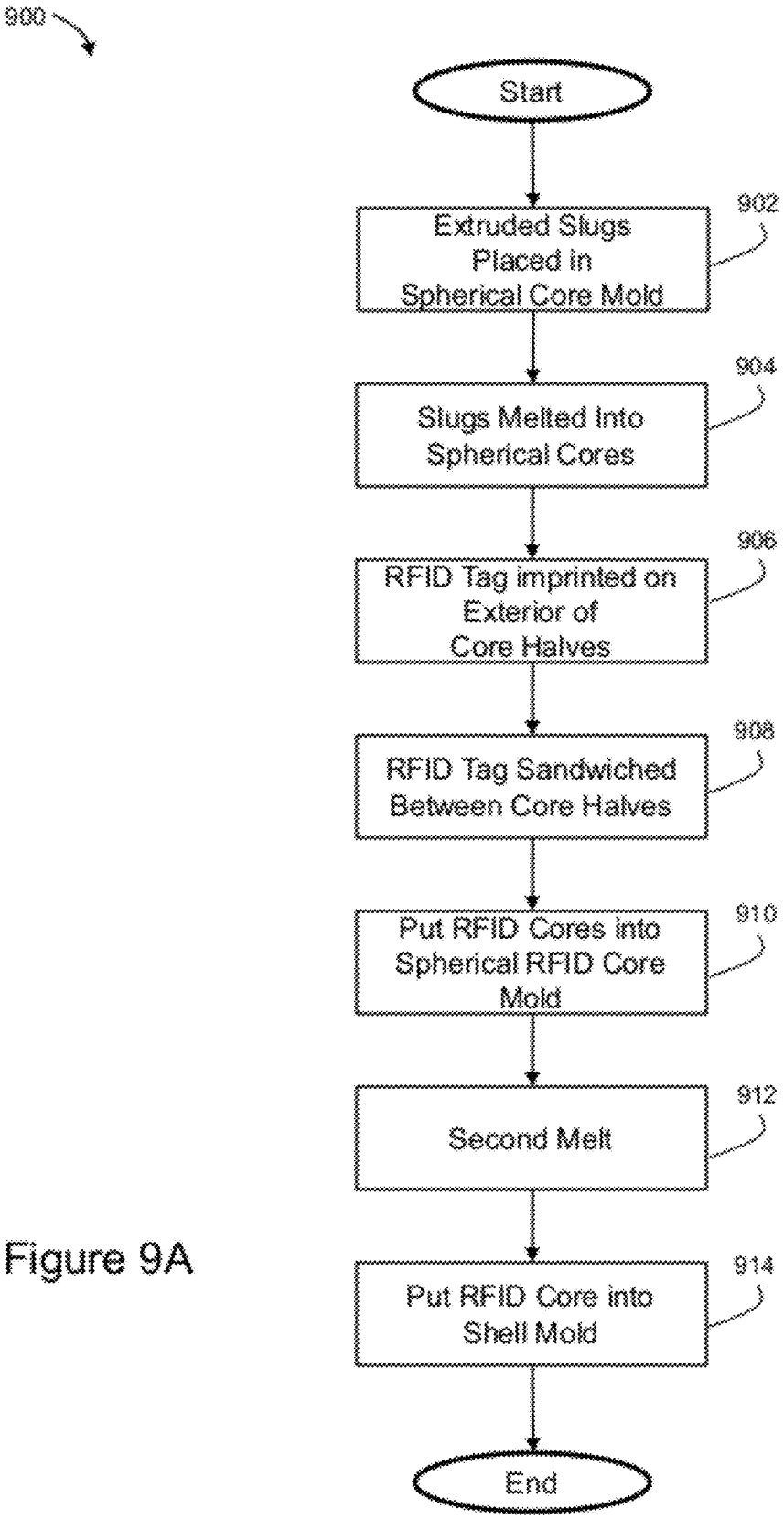

FIG. 9A shows an illustrative method for fabricating an omnidirectional RFID golf ball.

Figure 9B:
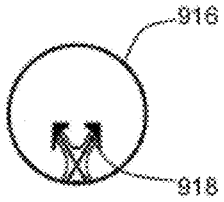
Figure 9C:
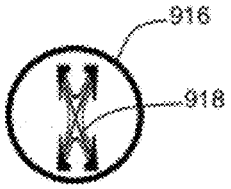

FIGS. 9B and 9C show another illustrative omnidirectional RFID golf ball.

Figure 9D:
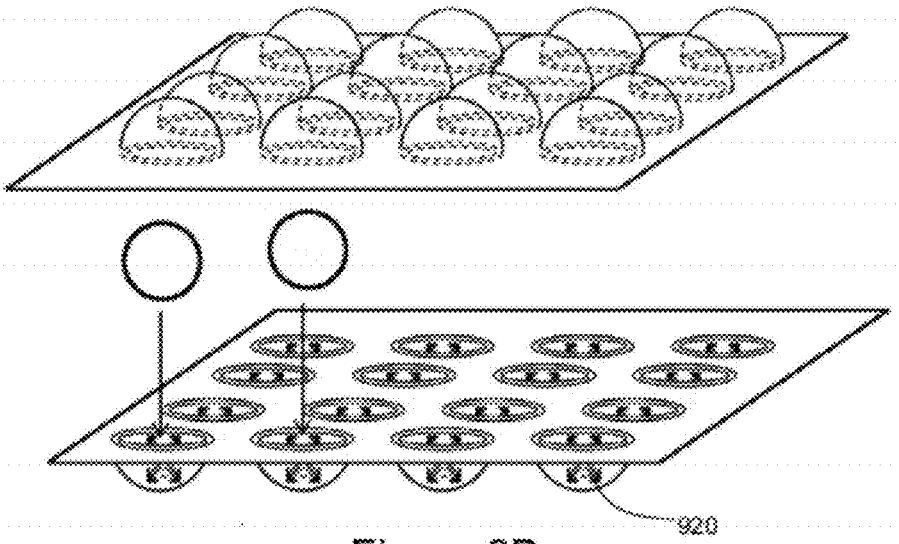
Figure 9E:
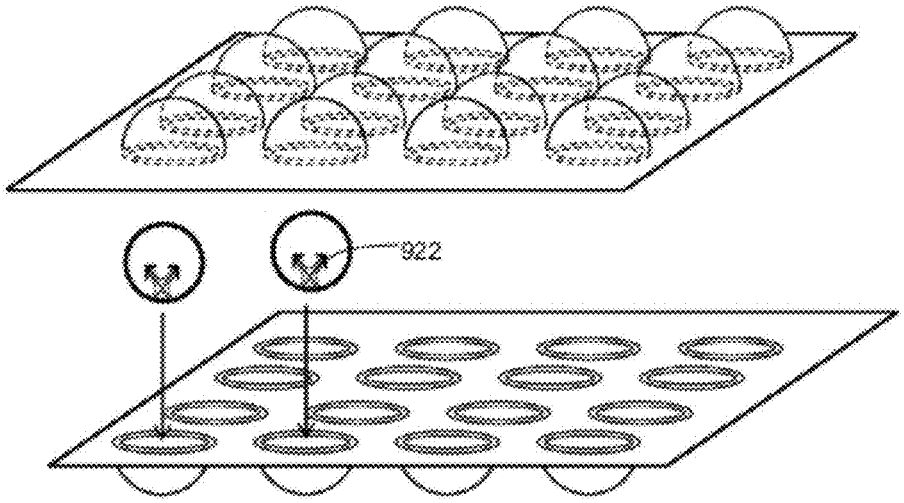

FIGS. 9D and 9E show various states for manufacturing the omnidirectional RFID golf ball.

Figure 9F:
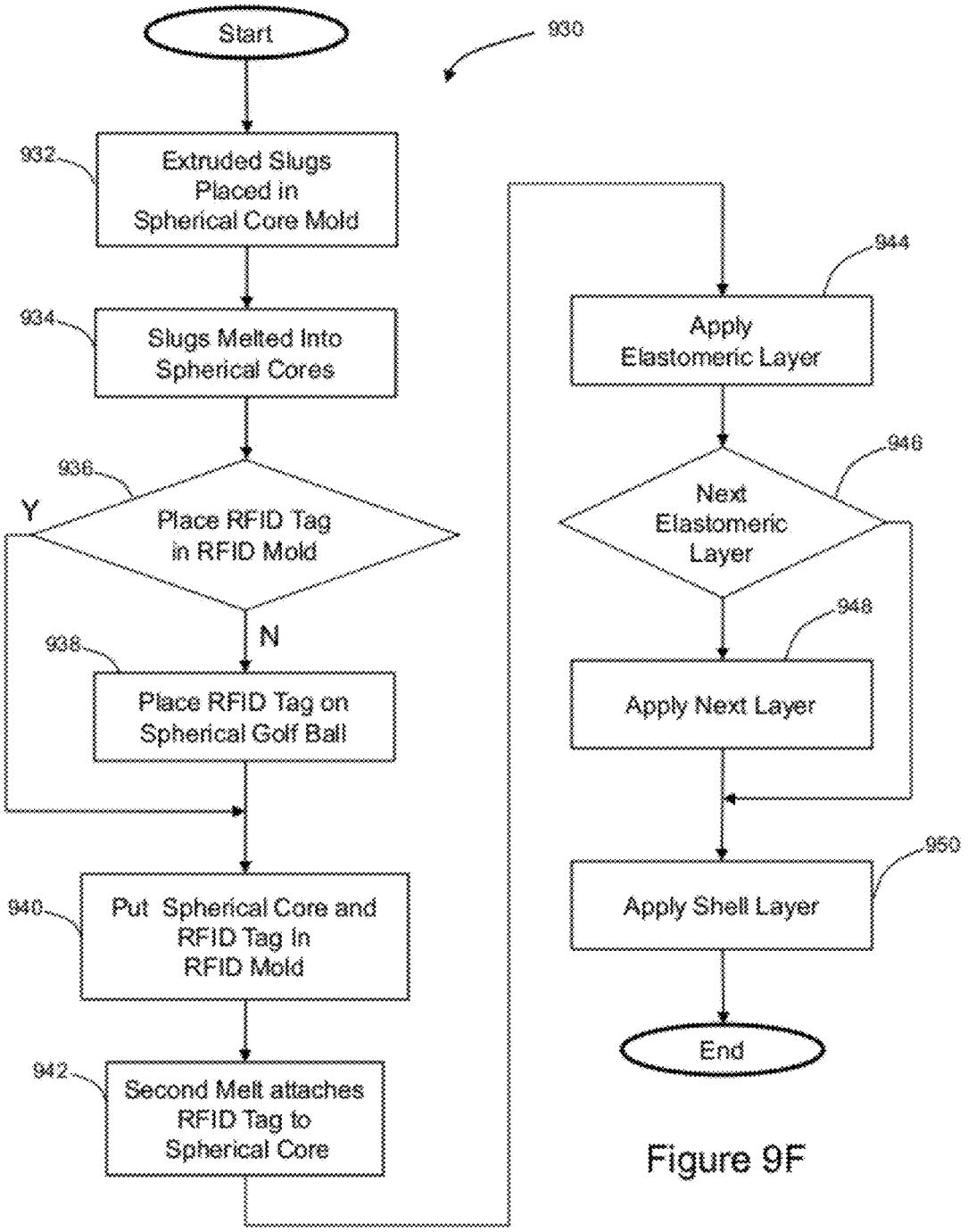

FIG. 9F shown an illustrative method for manufacturing the omnidirectional RFID golf ball.

Figure 10A:
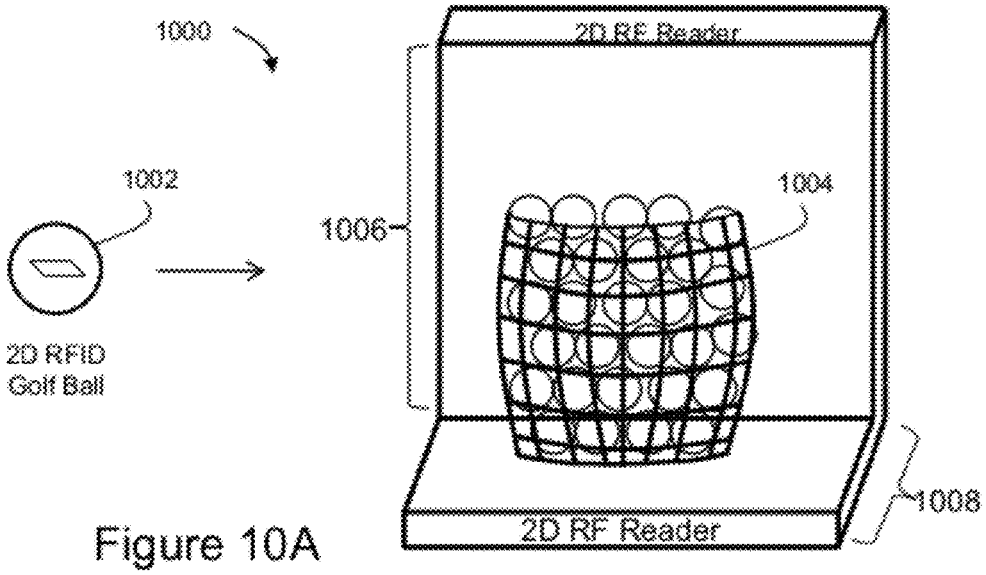

FIG. 10A shows an illustrative issue area RFID reader for a 2D RFID golf ball.

Figure 10B:
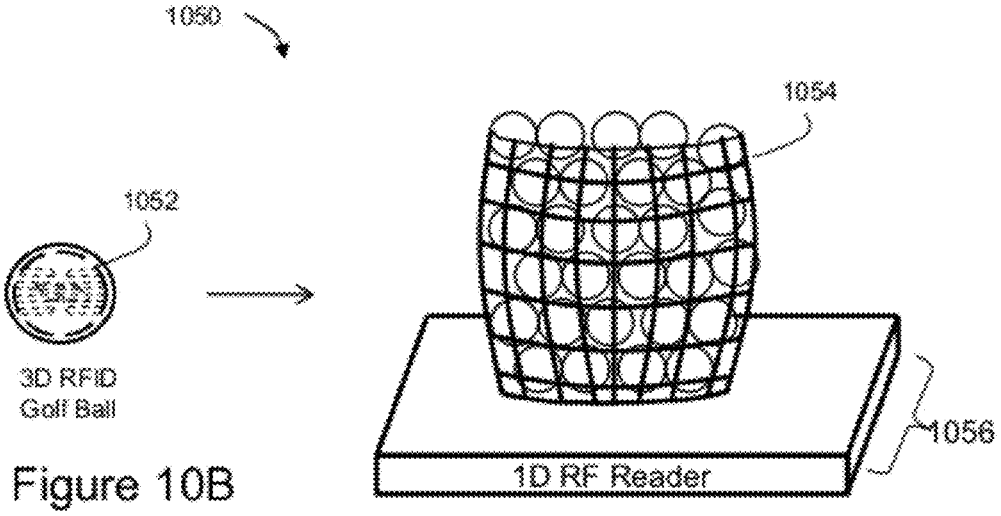

FIG. 10B shows an illustrative issue area RFID reader for an omnidirectional RFID golf ball.

Figure 11A:
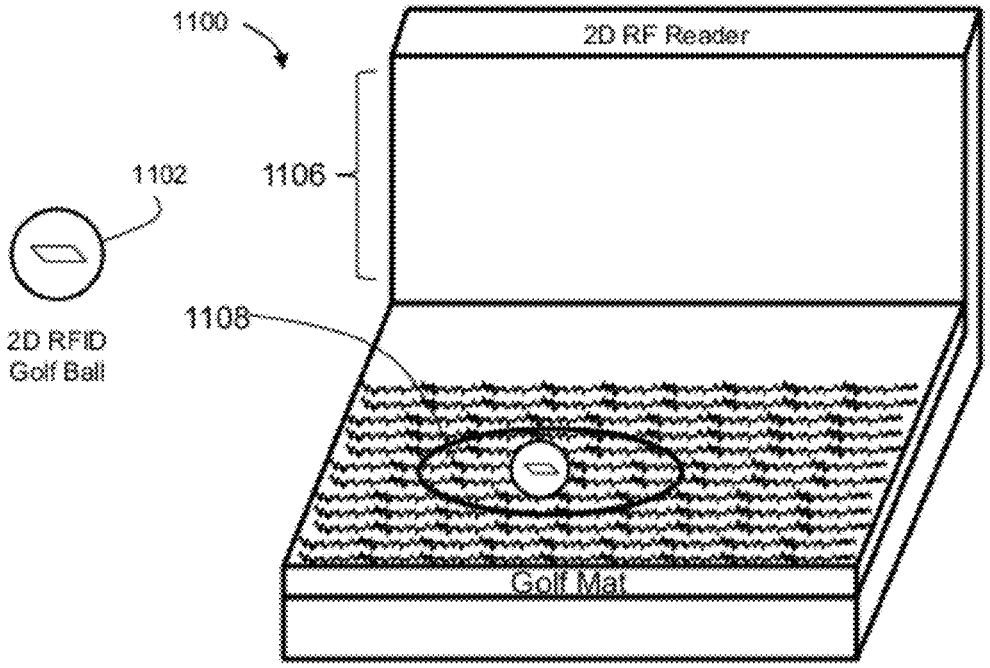

FIG. 11A shows an illustrative tee area RFID reader for a 2D RFID golf ball.

Figure 11B:
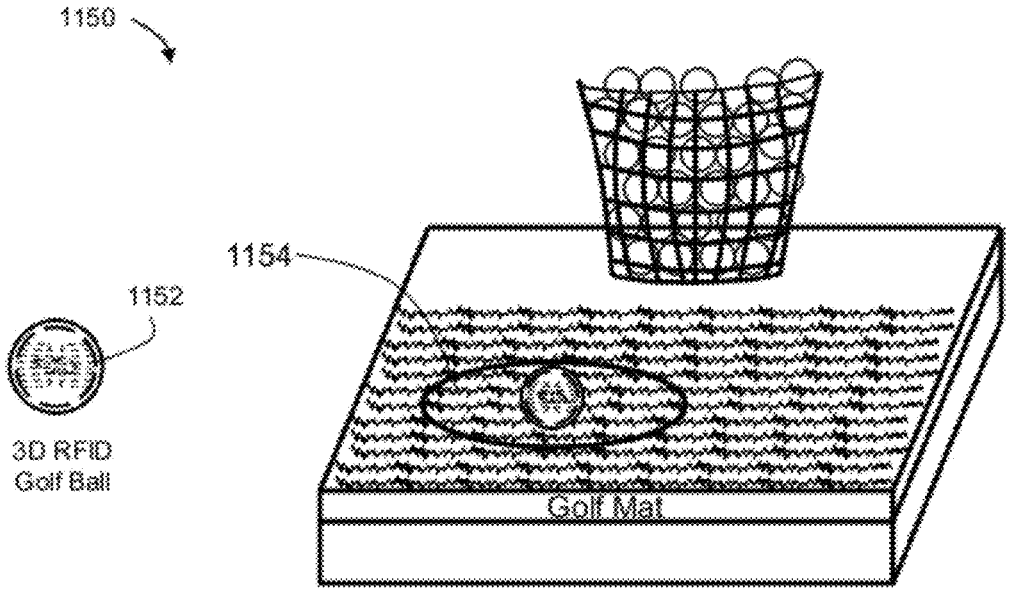

FIG. 11B shows an illustrative tee area RFID reader for a 3D RFID golf ball.

Figure 12A:
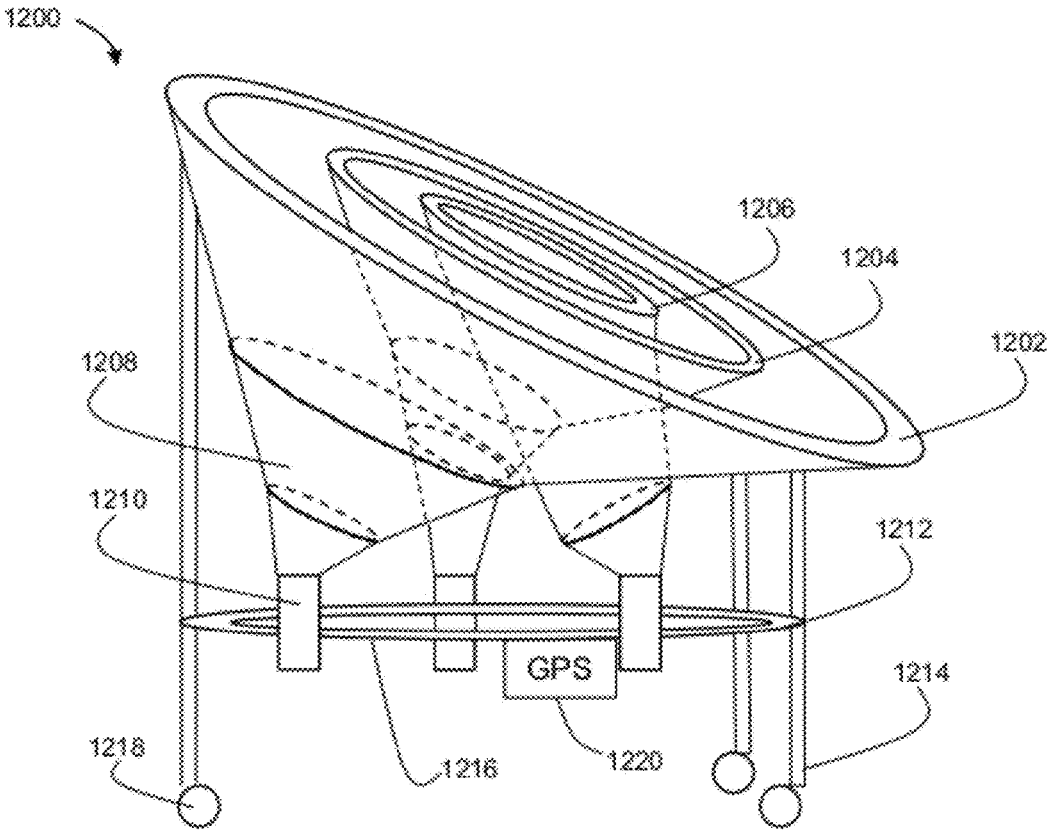

FIG. 12A shows an illustrative movable target having a plurality of nested funnels.

Figure 12B:
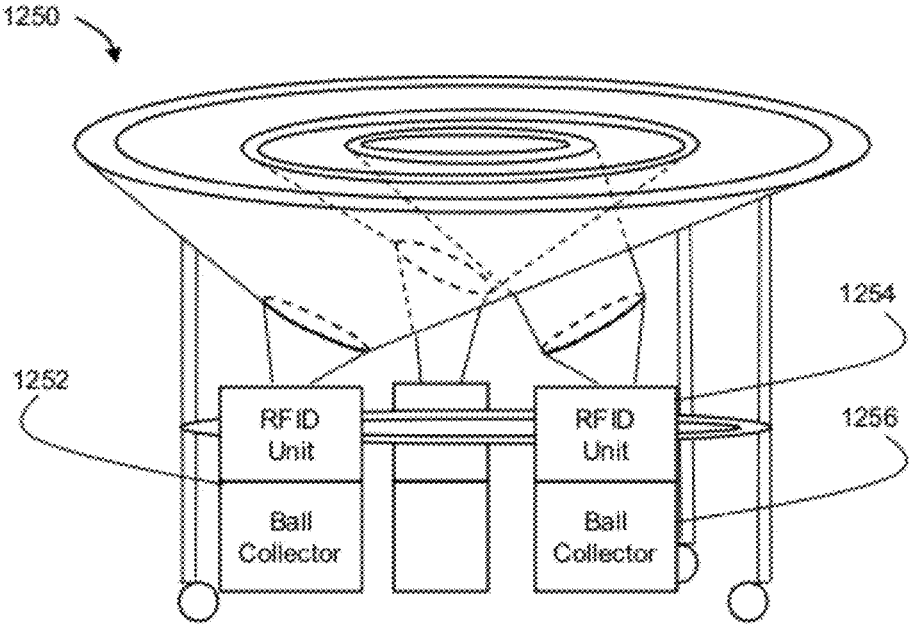

FIG. 12B shows an illustrative movable target having RFID-enabled ball receivers.

Figure 13A:
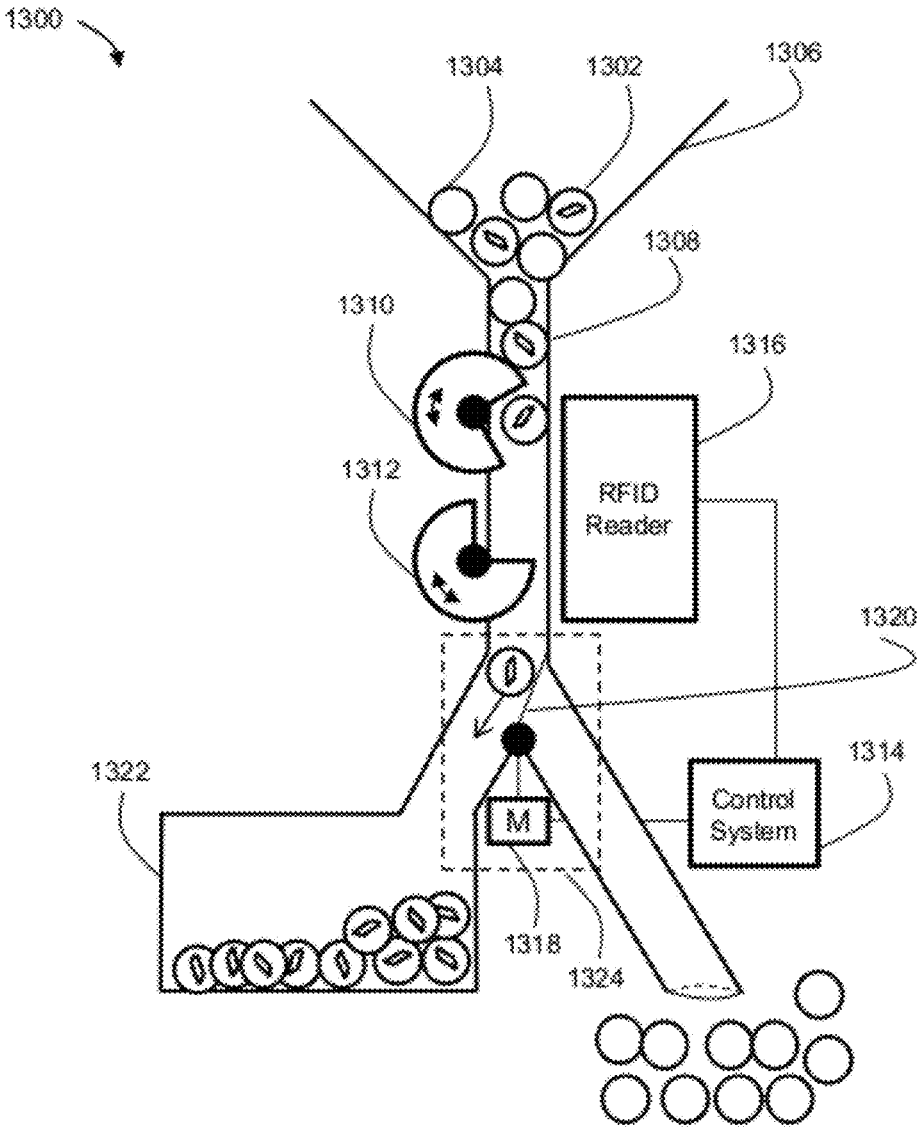
Figure 13B:
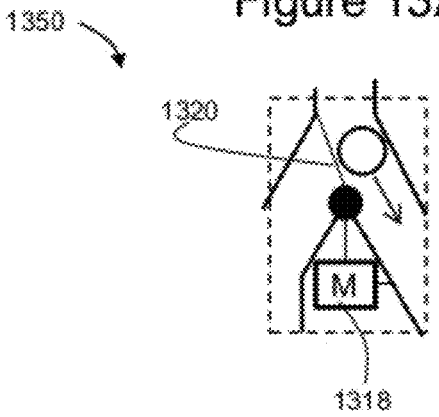

FIG. 13A-13B show an illustrative ball separation system.

Figure 14:
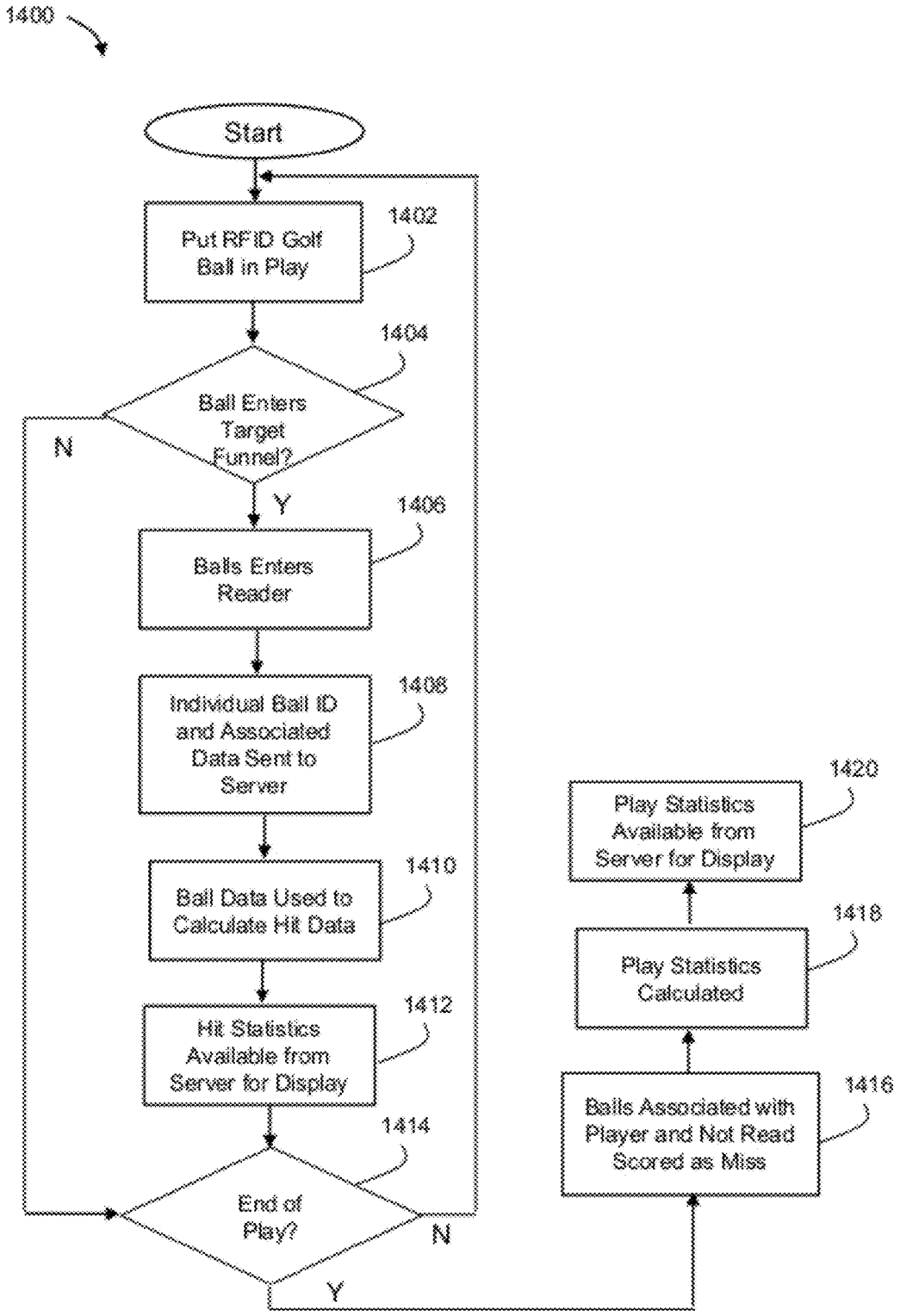

FIG. 14 shows an illustrative method for scoring driving range play using RFID-enabled movable targets.

DETAILED DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the golf range target with RFID ball identifier systems and methods described hereinafter may vary as to configuration and as to details.

In the illustrative embodiment described herein, the RFID golf ball range target system includes a RFID golf ball, a golf driving booth, a scanner, a client computer, a game selection module, a golf ball dispenser, an issuing area RFID reader, a target having a target capture area, a target RFID reader and a target network communications module.

The RFID golf ball that includes a RFID tag fixedly coupled to the surface of a spherical golf ball core corresponding to the RFID golf ball, wherein the RFID tag is disposed between the spherical golf ball core and a spherical golf ball shell. A unique RFID golf ball identifier is associated with the RFID golf ball. In the illustrative embodiment, the RFID tag includes an omnidirectional antenna that operates in the ultra-high-frequency (UHF) range. Additionally, the illustrative RFID tag can be encapsulated in a flexible substrate that is disposed between the spherical golf ball core and a spherical golf ball shell.

The illustrative golf driving range booth includes a scanner configured to scan an electronic device having a player ID that is associated with a particular player. The golf driving range booth also includes a client computer with an illustrative touch screen display that presents player information associated with the player ID. The game selection module is presented on the client computer and allows the player to select from a variety of different games.

The golf driving range also includes the golf ball dispenser that houses the RFID golf balls. The issuing area RFID reader associated with the golf dispenser reads the RFID golf balls that are associated with the player ID. The issuing area RFID reader is also communicatively coupled to the issuing area network communications module.

The player hits the RFID golf ball to the target having a known geographic location. The target includes an enclosed boundary capture component, a target RFID reader, and a target network communications module. The enclosed boundary capture component is configured to receive at least one RFID golf ball in a capture area. The target RFID reader is associated with the capture area and is configured to read the RFID golf ball. The target network communications module communicates a plurality of reads associated with the target RFID reader reading a plurality of RFID golf balls.

Additionally, the golf range target system includes a series of RFID readers and one or more driving range targets which may include one or more concentrically arranged targets.

RFID golf balls may be dispensed at the golf driving range hitting booth, or the player may bring a personal set of RFID golf balls to the range, or a player may receive a set of RFID golf balls at a centralized location that is provided by the driving range.

The set of RFID golf balls for the player are each identified by an issuing area RFID reader and a database entry associating the player with each ball in the set that is created. The golf balls are played from a golf driving range hitting booth or tee box, from which the player will hit balls from a tee onto the driving range.

When the golf ball is in the tee area, the golf ball identification is read by a RFID reader at the tee area. When the ball is hit onto the driving range, it may land in a target. The target contains a RFID reader that identifies the ball as it passes through the target.

In one embodiment, the targets are portable to allow repositioning of the targets on the range. The portable targets are equipped with GPS or other positioning systems, allowing the position of the target relative to the tee area to be determined. In this manner, the player may receive feedback about, for example, the location and distance of travel of each ball that the player hit onto the range.

In another embodiment, the targets are fixed and the RFID golf balls are read using RFID antennas and readers that are covered by turf in the driving range. The RFID and readers occupy a capture area similar to the portable targets described herein.

Figure 1A:
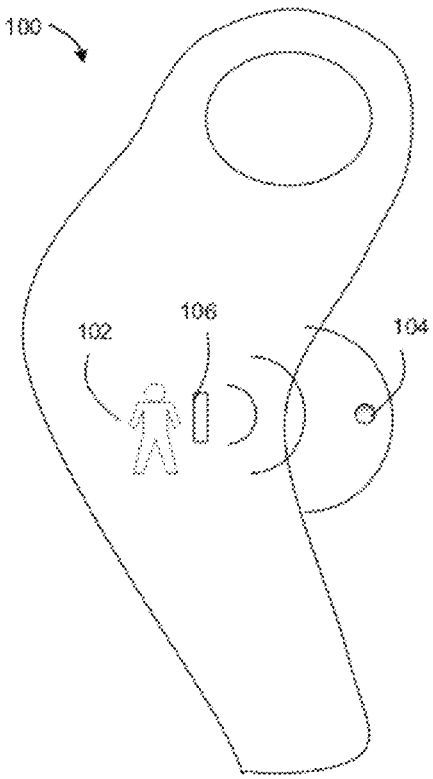
Figure 1A (Prior Art)
FIG. 1A shows a prior art system for determining the distance of travel of a golf ball.
Figure 1B:
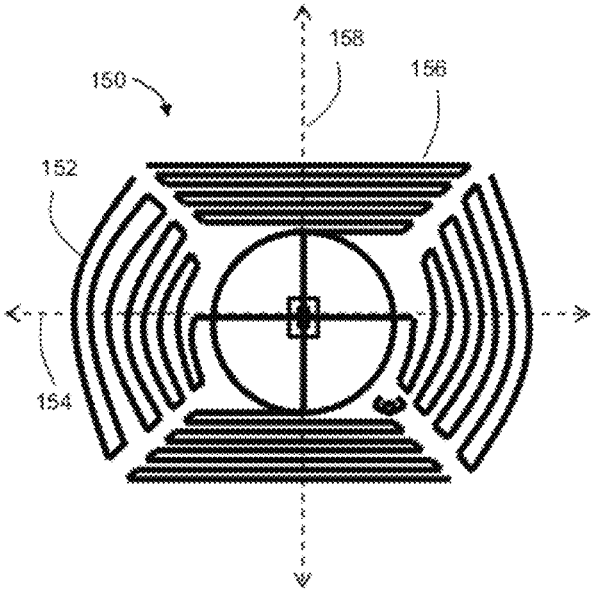
Figure 1B (Prior Art)
FIG. 1B shows a prior art radio-frequency identification (RFID) transponder.

Referring now to FIGS. 1A and 1B there is shown a prior art system 100 for determining the distance of travel for a golf ball with RFID golf ball. A player 102 hits a golf ball having embedded RFID tag 104. The player then uses a handheld RFID reader 106 to detect the golf ball. The handheld reader calculates the distance between the handheld reader and the golf ball. The RFID tag includes a first antenna 152 oriented along a first axis 154 and a second antenna 156 oriented along a second axis 158 that is perpendicular to the first axis. The perpendicular arrangement of the antennae 152 and 156 allows the RFID transponder to be sensitive along the plane defined by the first axis and the second axis.

Figure 1C:
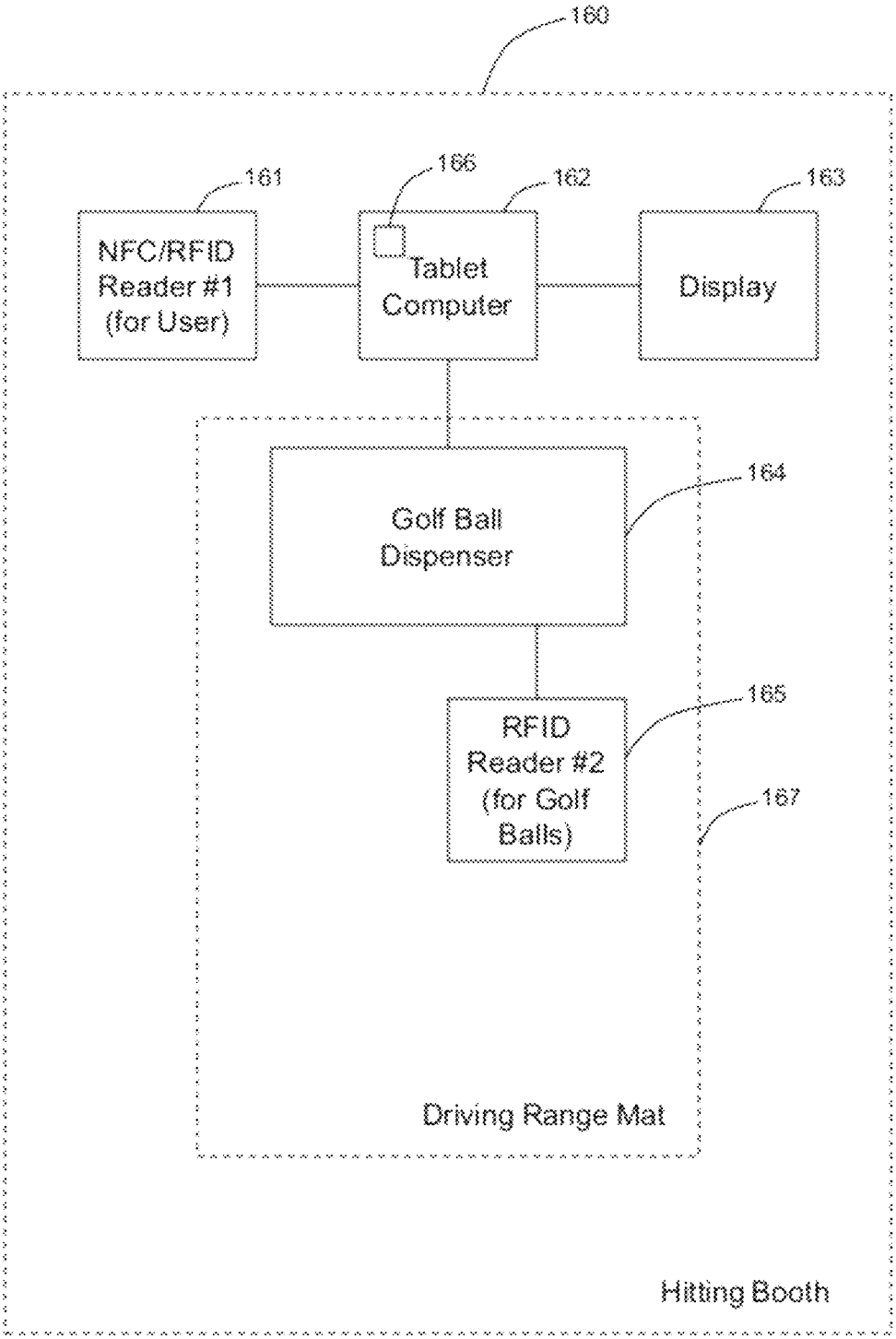
FIG. 1C shows the system components in an illustrative golf driving range hitting booth.

Referring to FIG. 1C there is shown an illustrative system of components in an illustrative golf driving range hitting booth. The illustrative hitting booth 160 includes a scanner 161, a client computer 162, a display 163, a golf dispenser 164 and a RFID reader 165. The illustrative scanner 161 is a Near Field Communications (NFC) reader or a RFID reader for a membership card with a RFID tag. The illustrative scanner reads an electronic device (not shown) that is associated with the particular player. The illustrative electronic device may be a wireless handset or RFID card associated with the particular player.

After the scanner 161 reads the player's electronic device, an identification (ID) number associated with the player's electronic device is activated in a centralized database (not shown) and the illustrative tablet computers 162 and display 163 presents the player information. The illustrative client computer 162 is a tablet computer such as an iPad® manufactured by Apple. The display is a much larger and presents the player information to other players in proximity of the hitting booth 160.

In operation, a player enters the golf driving range hitting booth 160. On an illustrative client computer 162 such as an iPad® tablet computer mounted to an support column (not shown) on one side of the booth, the player scans his or her electronic device such as a Near Field Communications (NFC) device or a membership card with a RFID tag is read by the scanner 161. The electronic device identifies the particular player. More players can join the game at the hitting booth or via a gaming server from different booths or site locations, thereby allowing for other players from other locations to play against one another.

After the player selects a game using tablet computer 162, a RFID golf ball is dispensed from golf ball dispenser 164. In the illustrative embodiment, a golf ball with a UHF omnidirectional RFID chip is dispensed on to a driving range mat by golf ball dispenser 164. A more detailed description of the RFID golf ball is provided below.

When the golf ball dispenser 164 dispenses the RFID golf ball, the RFID reader 165 with a RFID near field read (NFR) antenna reads the RFID golf ball. The RFID reader 165 is communicatively coupled to a network having a server that receives the RFID golf ball information. More particularly, the unique ID from the RFID tag in the RFID golf ball is read and inserted into a database table that contains the logged-in user ID. After the golf ball rolls onto the driving range mat, the golf ball is hit by the player.

The illustrative client computer 162 includes a touch screen display that allows a player to interact with a game selection module 166. The game selection module 166 includes at least one game of skill, in which an award is provided when the RFID golf ball associated with the player ID is read by the target RFID reader that is associated with the capture area. By way of example and not of limitation, the award may be a predetermined number of points based on the distance and size of the capture area.

In an alternative embodiment, the game selection modules 166 includes at least one game of chance, in which a game session for the game of chance is initiated when the RFID golf ball associated with the player ID is read by the target RFID reader, a random result for the game session is generated, and a paytable associates a prize with the random game session result. The awarded prize is then displayed to the player.

In another embodiment, the game selection module 166 includes a game that has both a first game of skill component and a second game of chance. The embodiment starts with the player, by way of example and not of limitation, hitting the ball in the target area and getting points, and a subsequent game of chance, i.e. spinning a wheel for additional points. In operation, a first award is initially provided when the RFID golf ball is received by the capture area. This first award is based on the player's skill in hitting the ball at the appropriate target. The player then has the opportunity to play a second game of chance. By way of example and not of limitation, the second game may be referred to as a bonus game, in which the bonus game is a game of chance, where the player gets to spin a wheel. The random prize corresponding to the spinning wheel is then awarded to the player. Alternative games of chance include reels in a slot machine, virtual scratcher, bingo card, lottery game or other such graphic representation of a game of chance.

In another game embodiment, after a predetermined number of misses by the player, e.g. after 20 balls have been hit but none landed in the target area, the game session for the game of chance is initiated. Therefore, the player can continue to play the game and win points, even if he or she lacks the skill necessary to hit the golf ball into the target.

Figure 1D:
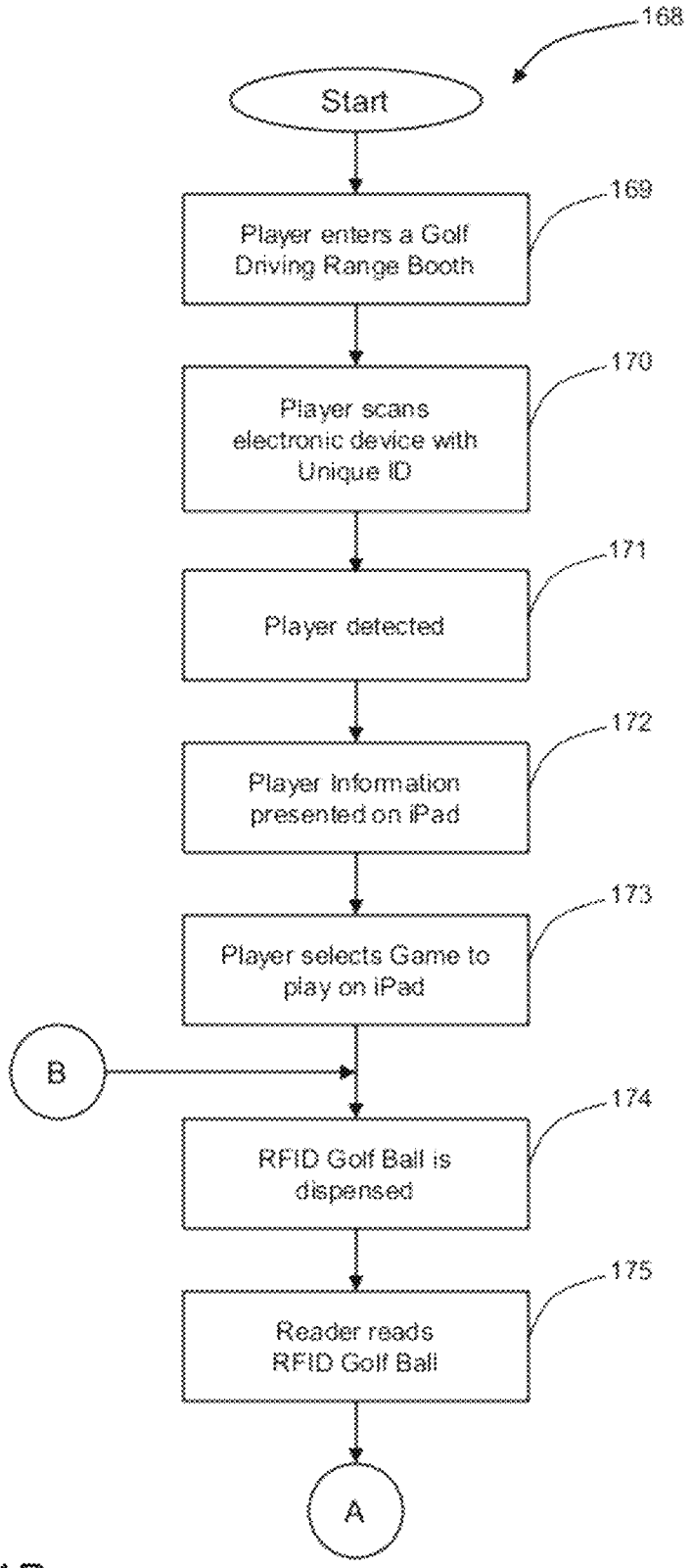
FIG. 1D shows a first portion of an illustrative method for operating a RFID golf ball range target system.

In FIG. 1D, there is shown a first portion of an illustrative method 168 for operating a RFID golf ball range target system. The method is initiated at block 169, when the player enters a golf driving range booth. At block 170, the player scans an electronic device with a unique ID and the player is detected at block 171. Player information is presented at block 172. The player then proceeds to select a game to play on a tablet computer as described in block 173. At block 174, the RFID golf ball is dispensed and the reader reads the RFID golf ball at block 175.

Figure 1E:
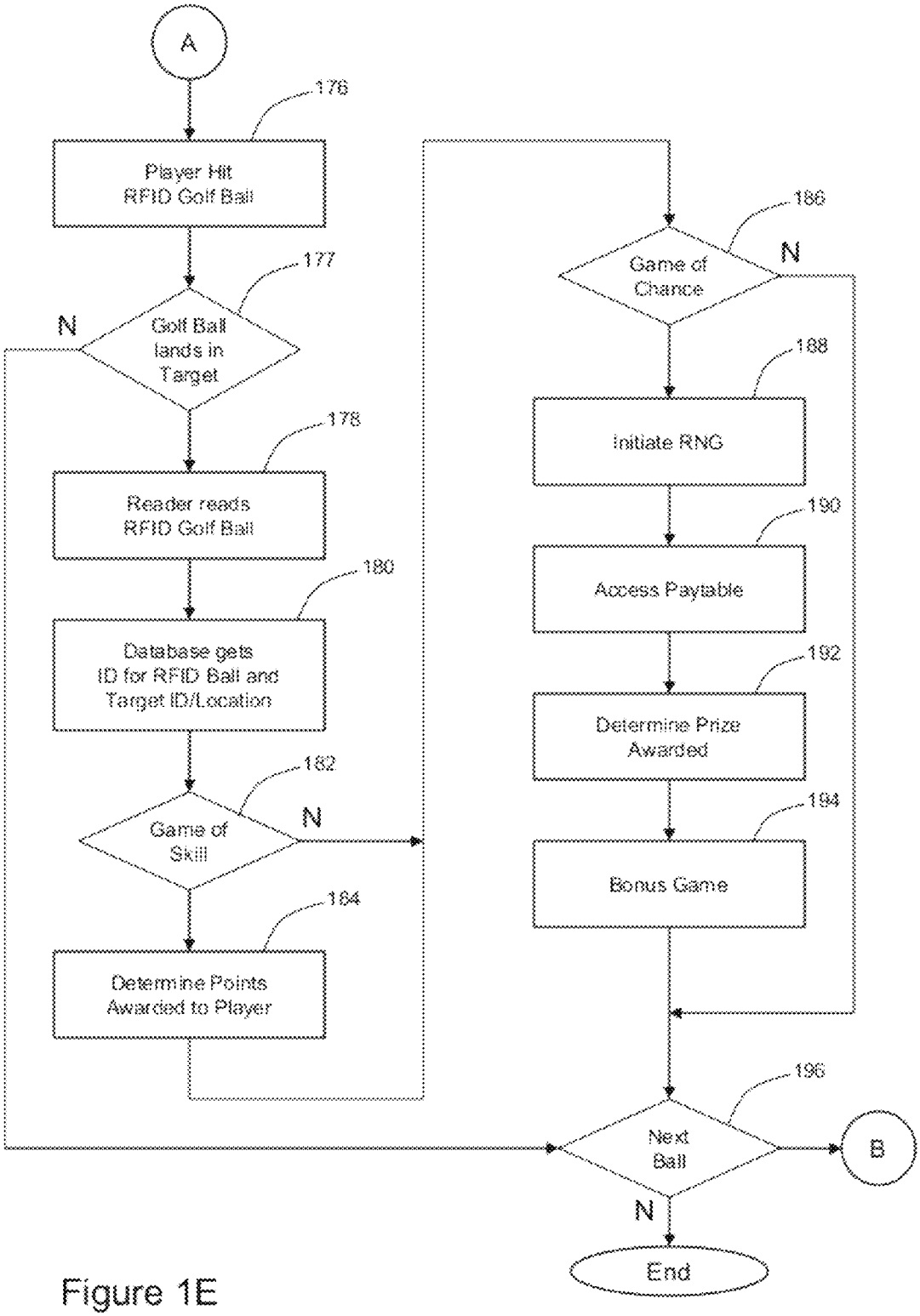
FIG. 1E shows a second portion of the illustrative method for operating the RFID golf ball range target system.

FIG. 1E shows a continuation of the illustrative method 168 for operating the RFID golf ball range target system. At block 176, the player hits the RFID golf ball. The method then proceeds to decision diamond 177, where a determination is whether the golf ball hit the target area. If the golf ball lands in a target, the RFID golf ball is channeled into another RFID NFR antenna and RFID reader computer that is connected to the network as described in further detail below.

If the RFID ball does not land in the target area, then the method proceeds to decision diamond 196, where a new golf ball may be dispensed and zero (0) points are awarded for the missing the target area.

At block 178, the target RFID reader(s) read the RFID golf ball. The golf balls unique tag ID is read from the golf ball and the location of the target's ID is sent to the database.

At block 180, the database gets the ID for the RFID ball and Target ID/location. The golf unique ID is searched for and if the ball ID is found allocated to a current logged in player, a database point list algorithm determines the points for that target and an action is triggered.

At decision diamond 182, a determination is made whether a game of skill has been initiated. If a game of skill has been initiated, an amount of points is awarded to a player at block 184. In the illustrative embodiment, points associated with a particular target, player ID and game session are associated with the appropriate database fields.

At decision diamond 186, a determination is made whether a game of chance has been initiated. In first game of chance embodiment, when the RFID golf ball lands in a target, a slot machine reel spins on the tablet client computer 162 and display 163 at the players hitting booth 160. The awarded points are then calculated in the database for that player and posted to the player's displays, on a web site and various displays throughout the facility (like a leader board).

In another game of chance embodiment, an illustrative random number generator is initiated is initiated at block 188. At block 190, the appropriate paytable is accessed for the particular game of chance. The prize that is awarded according to the paytable is determined at block 192. At block 194, an illustrative bonus game is initiated.

At decision diamond 196, a determination is made whether to play the next ball. The database of points for the active player is then displayed in a game format on the tablet and display at the hitting booth, on a web site and various displays throughout the facility (like a leader board).

Figure 2:
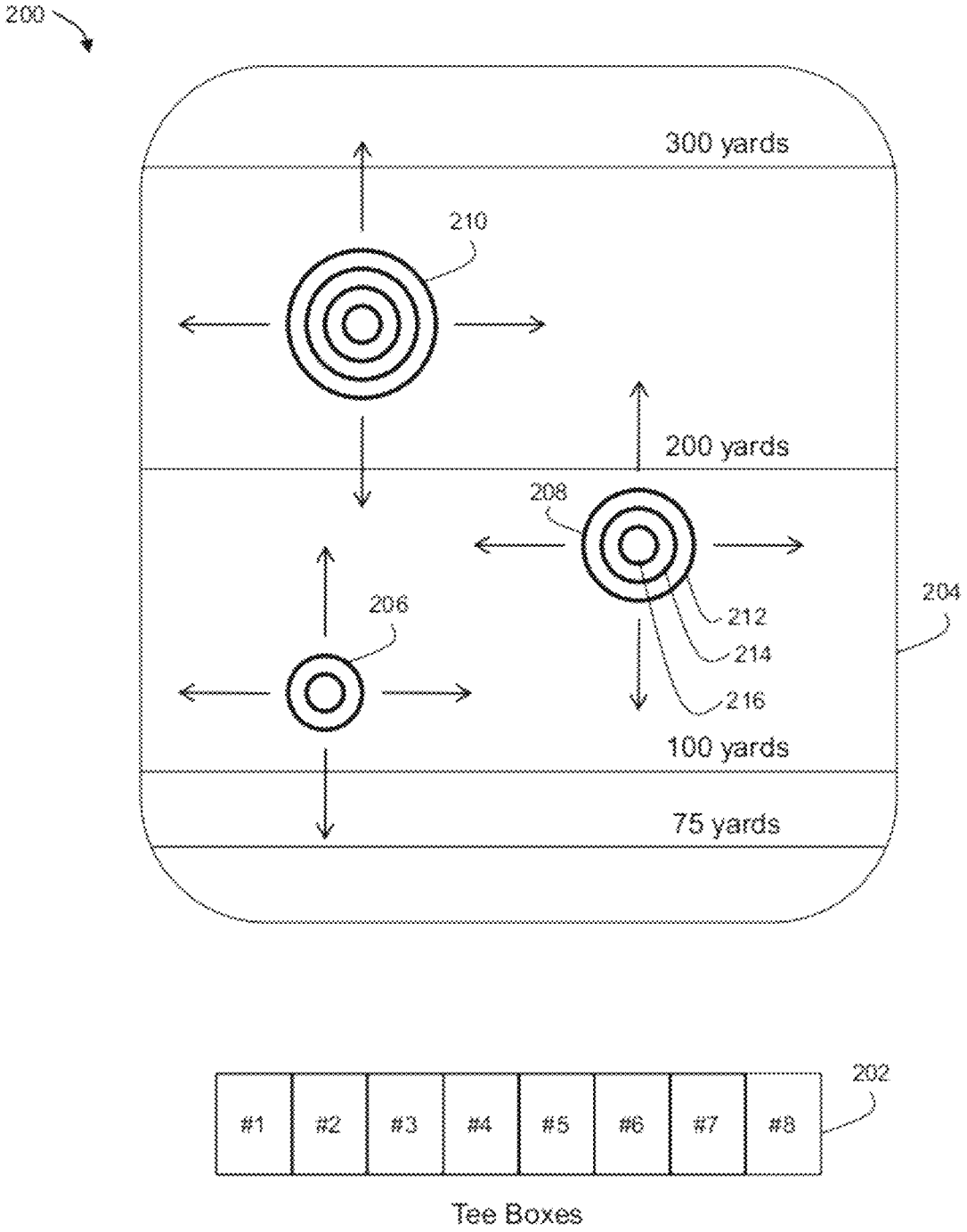
FIG. 2 shows an illustrative driving range having movable targets.

Referring to FIG. 2, an illustrative driving range 200 having movable targets is shown. Tee area 202 has tee boxes numbered #1 through #8. A player enters one of the tee boxes and hits a golf ball from the tee box onto the target area 204, with the objective of hitting a ball into one of the movable targets. Movable targets 206, 208, and 210 are shown. The arrows shown adjacent to the targets indicate that the targets are movable. Any of the targets may be relocated to any position on the target area 204.

The movable targets include at least one enclosed boundary capture component having a top boundary edge, a bottom boundary edge, and a tapering surface material that joins the top boundary edge to the bottom boundary edge. By way of example and not of limitation, the tapering surface material may be composes of a plastic UV resistant material. The shape of the enclosed boundary components can include curved sectors or segments that are connected to one another resulting in a variety of different sizes and shapes. Thus, the shape of the enclosed boundary capture component is determined by engineering and design constraints.

Figure 5:
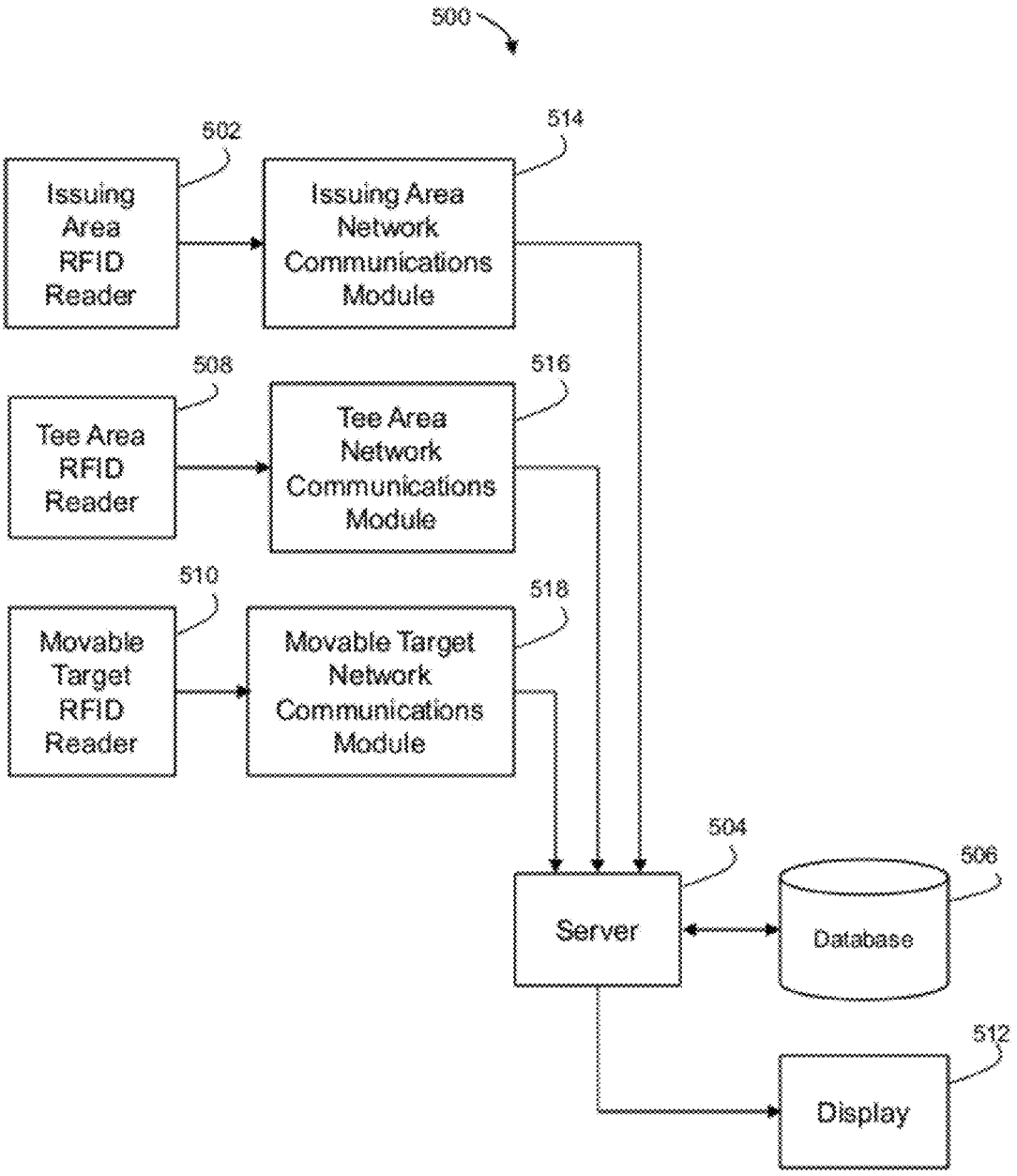
FIG. 5 shows an illustrative system diagram for the golf range target system.

In the illustrative embodiments presented herein, the movable golf range target system includes an issuing area RFID reader, which is presented in FIGS. 3, 10, 11 and 13. The movable target is shown in FIGS. 2, 12 and 13. The issuing area RFID reader is configured to read a plurality of RFID golf balls associated with a player, wherein each RFID golf ball has a unique identification. The RFID golf balls are shown in FIGS. 3, 6, 8, 9 and 10. The issuing area RFID reader is communicatively coupled to an issuing area network communications module as shown in FIG. 5.

Referring now to FIG. 12, there is shown the movable target includes two enclosed boundary capture components, two target RFID readers and a GPS receiver. Additionally, the first enclosed boundary capture component has a first top boundary perimeter and a first bottom boundary perimeter, in which the first top boundary perimeter is configured to receive at least one RFID golf ball that subsequently travels through the first bottom boundary perimeter. A first target RFID reader is proximate to the first bottom boundary perimeter of the first enclosed boundary capture component, and the first target RFID reader is configured to read the unique identification for each RFID golf ball that travels through the first bottom boundary perimeter. A second enclosed boundary capture component encompasses the first enclosed boundary capture component and the second enclosed boundary capture component has a second top boundary perimeter that is greater in length than the first top boundary perimeter. In the illustrative embodiment of FIG. 12, the second target RFID reader is proximate to a second bottom boundary perimeter of the second enclosed boundary capture component and the second target RFID reader is configured to read the unique identification for each RFID golf ball that travels through the second bottom boundary perimeter. The GPS receiver is coupled to the movable target and the GPS receiver is configured to determine a geographic location of the movable target.

For illustrative purposes, the enclosed boundary capture component is presented as a funnel in FIG. 2 and FIG. 12. In the illustrative embodiments presented herein in FIG. 12A and FIG. 12B, the plurality of enclosed boundary capture components are presented as concentric funnels. The concentric funnels may be used to reward the accuracy of the hitting the target by awarding the player a higher point value for landing the ball within an interior funnel, with the highest point value awarded for landing a ball within the innermost funnel.

Referring back to FIG. 2, if the player is aiming for target 208, the player will be awarded a point value for landing a ball in exterior funnel 212. A higher point value is awarded for landing the ball in inner funnel 214. The highest point value for target 208 is awarded when the player is able to land a ball in innermost funnel 216. In one embodiment, the target is a fixed target and includes RFID antennas under turf such as Astroturf. The RFID antennas are then associated with a particular RFID reader.

Figure 3A:
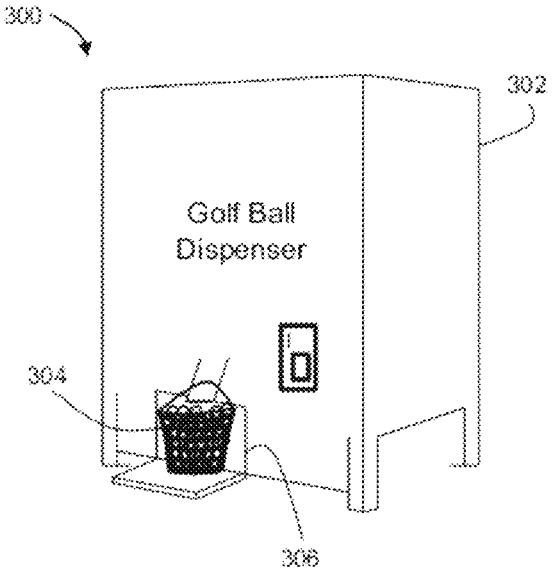
FIG. 3A shows an illustrative system for identifying multiple golf balls simultaneously at a golf ball dispenser.

Referring now to FIG. 3A, an illustrative system 300 for identifying multiple golf balls simultaneously at a golf ball dispenser is shown. The golf ball dispenser 302 is typically a hopper containing a large quantity of golf balls. The golf ball dispenser releases golf balls into an illustrative bucket 304 via a chute. The golf ball dispenser may have a money insertion slot and/or credit card reader or other transaction facilitating device to receive payment for the dispensed balls. The dispenser may release a fixed quantity of balls or may release different quantities depending on the amount of money paid to the dispenser. In some embodiments, balls are released incrementally in groups having a number equivalent to a maximum number of balls that may be simultaneously read by the RFID reader. The golf ball dispenser may include a RFID reader 306, shown in more detail in FIG. 3B.

In an alternative embodiment, the golf dispenser 302 dispenses individual RFID golf balls in the illustrative hitting booth 160 described above in FIG. 1C.

Figure 3B:
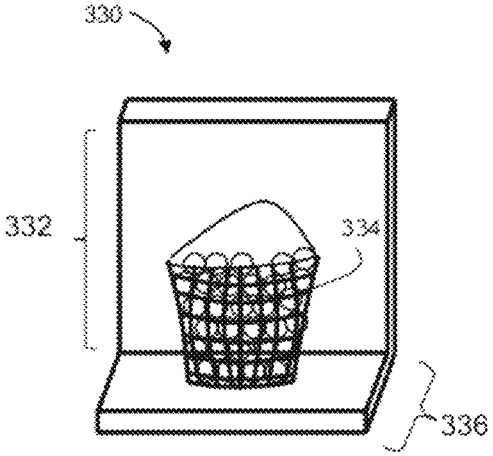
FIG. 3B shows an illustrative RFID reader for simultaneously identifying each ball in a collection of RFID golf balls.

Referring now to FIG. 3B, an illustrative RFID reader 330 for simultaneously identifying each ball in a collection of golf balls is shown. The reader component may comprise antennae located in horizontal panel 332 located adjacent to ball bucket 334 and in platform 336 on which the bucket 334 rests. The reader component detects the unique ID associated with the RFID transponders located within the golf ball. The reader is capable of detecting the ID of every golf ball located in the bucket. The RFID reader may operate using inductive coupling. In some embodiments, the RFID reader identifies the balls using backscatter coupling.

Figure 3C:
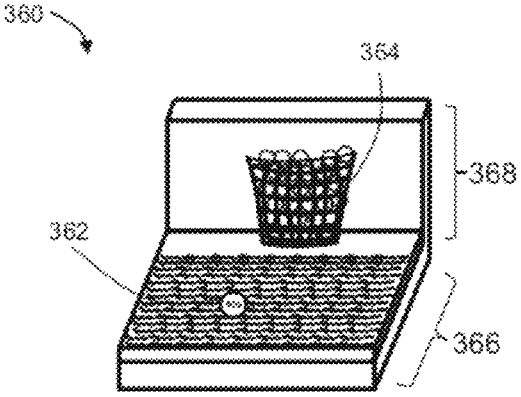
FIG. 3C shows an illustrative RFID reader for identifying a ball at a tee box.

Referring to FIG. 3C, an illustrative RFID reader 360 for identifying a ball at the tee box is shown. When the player arrives at the tee box, the player takes a ball 362 from the bucket 364 and places it on a tee in preparation to hit the ball onto the range. The ball may be identified by a RFID reader 366 when the ball is placed on the tee. The reader may be located, for example, in the platform below the tee. In some embodiments, each ball in the bucket is identified when the bucket is located in the tee box. In some embodiments, a reader for simultaneously identifying the collection of golf balls is located at the tee area. The reader for identifying all of the balls in a bucket may be located in a vertical panel 368 located adjacent to a designated area for resting bucket 364, or the reader may be located in a platform supporting the bucket.

Figure 4:
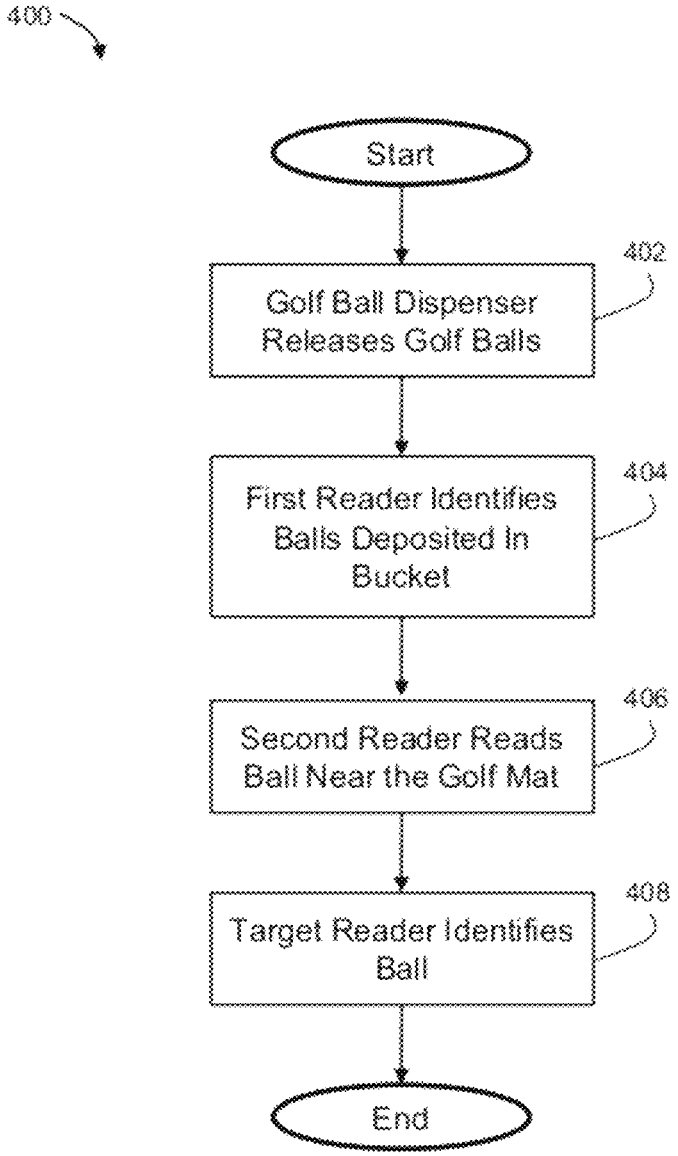
FIG. 4 shows an illustrative method for tracking RFID golf balls at a driving range.

Referring to FIG. 4 there is shown an illustrative method 400 for tracking RFID golf balls at a driving range. The method begins at block 402 where the golf ball dispenser 302 receives a command to release a quantity of golf balls into a bucket or into the driving range mat 167 in hitting booth 160.

The method proceeds to block 404 where a RFID reader identifies all of the balls deposited into the bucket or into the driving range mat 167 in hitting booth 160.

At block 406, after the bucket has been transported from the golf ball dispenser area to the tee area, a second RFID reader located at the tee area reads a golf ball when it is at or near the tee box. At block 408, after a golf ball is hit from the tee and lands in a target area, the ball is read at the target area by another RFID reader.

Referring to FIG. 5, an illustrative system diagram 500 for the golf range target system is shown. In the illustrative embodiment, the player obtains a set of RFID golf balls dispensed by a golf ball dispenser such as that shown at 302 in FIG. 3. An issuing area RFID reader 502 may be a component of the golf ball dispenser, or may be located elsewhere at the driving range. The RFID golf balls are placed in or dispensed to an indicated designated area proximate to the issuing area RFID reader. Each RFID golf ball has a unique identification stored on the RFID transponder embedded within the ball. The issuing area RFID reader reads the unique identification from each of the plurality of balls. The issuing area RFID reader is communicatively coupled to an issuing area network communications module 514. The network communications module is a transmitter which sends a signal to another device on a network. The network may be, for example, a local area network or wide area network. The identification of each RFID golf ball in the player's set of RFID golf balls as detected by the issuing area RFID reader 502 is sent to server 504 via issuing area first network communications module 514. The server creates an entry in database 506 associating the identifications of the plurality of RFID golf balls with a unique identification associated with the player. The server and database may be located on site at the driving range. In some embodiments, the server or database or both the server and the database are located off site and receive communications from the RFID readers over, for example, a LAN or WAN. The server and database may be located in the same physical computer. Alternatively, an on-site server may be configured to communicate with an off-site server and database. Multiple databases may be used in conjunction with the one or more servers located on-site, off-site, or both. A multiple-site driving range establishment may use multiple servers to allow information to be collected from and distributed to the multiple sites.

In the instance where a player brings a set of RFID golf balls to the range, the player may in some embodiments rely on a previously created database entry associating the player with the player's set of golf balls and avoid having to use the issuing RFID reader after the initial entry is created.

The database may be configured to store additional information associated with a player including, but not limited to, a record of the player's play history at the driving range, transactional information and account information. The player ID and other information associated with the player may be stored on a card having a magnetic stripe or other readable media. Alternatively, the player may be issued a PIN number or username and password combination associated with the player ID. In some embodiments, a temporary player account is created for short term use of the driving range. The player may receive a paper voucher indicating a temporary player ID in human readable and/or barcode form. A paperless system for issuing a temporary player ID may involve communicating the player ID to the player visually or audibly, or associating a particular tee box with the player's set of RFID golf balls.

At the tee area, the player removes a ball from the set of RFID golf balls and places it on a tee in preparation for hitting the ball onto the driving range. The identification of the individual golf ball is obtained by tee area RFID reader 508 and sent to server 504 via a tee area network communications module 516 communicatively coupled to the tee area RFID reader. The communication of a RFID golf ball identification from the tee area network communications module to the server may occur when the ball is placed on the tee (on arrival at the tee area) or when the ball is hit off of the tee (on departure from the tee area). In some embodiments, the identification of the RFID golf ball is communicated when the ball is placed on the tee and again when it is hit from the tee area.

The ball is hit toward the movable golf range target. A RFID golf ball landing within the target is read by a RFID reader 510 associated with the target. The ball ID detected by the target RFID reader is sent to server 504 via a target network communications module 518 communicatively coupled to the target RFID reader. For each ball that lands within a movable target, the server may determine the distance the ball traveled from the tee to the target based on the location of the target as established by a GPS receiver coupled to the target. The distance determination may also take into account the location of the tee as determined from a known location of the tee associated with the second RFID reader. If the targets are arranged on the range such that space exists between the targets, the server may determine that a ball missed all targets when a RFID golf ball identified by the second RFID reader is not subsequently identified by a target RFID reader. A timestamp associated with the time the ball left the tee may be sent to the server. The timestamp may be generated by the second RFID reader when it determines that the RFID golf ball has left the tee. Alternatively, the timestamp may be generated by beam interruption detection or similar method. Information such as whether the RFID golf ball landed in a target, a point tally, distance traveled by a ball, timestamp associated with each time the ball is hit, and statistics for a single driving range session or multiple driving range sessions, may be presented to the player in various ways. For example, the information may be sent from server 504 to a display 512. The display may be, for example, a display mounted in the tee area or in another part of the driving range. In other embodiments, the information may be made available to the player for display on a handheld device or personal computer.

In some embodiments, no tee area RFID reader is used. In such embodiments, the RFID golf balls are associated with a player by the issue area RFID reader and read at the target area RFID reader.

In other embodiments, no issue area RFID reader is used. The one or more RFID golf balls are associated with a player at the tee area and read at the target area RFID reader.

Referring to FIGS. 6A-6C, various states of manufacture of the illustrative RFID golf ball are shown. A typical two-piece golf ball includes a core material encased in a molded shell. In FIG. 6A, a split core 600 is shown. In FIG. 6B, a RFID tag 602 is shown adjacent to the lower half 604 of the split core in preparation for sandwiching the RFID tag between the upper half 606 of the split core and the lower half of the core 604. The upper half of the core is placed on top of the lower half of the core 604 as shown at 610 and placed in a mold comprising lower tray 612 and upper tray 608 as shown in FIG. 6C. In the mold, the upper half of the core is melted to the lower half of the core such that the RFID tag is encased within the spherical core.

Alternatively, the illustrative RFID tag 150 is disposed on the outside or exterior of the core material, or on the exterior of a split core. The illustrative RFID tag 150 could be adhesively coupled to the exterior of the core material, or an annealing process could be used to couple the RFID tag to the core material, or the RFID tag could be printed on to the exterior of the core material using a conductive ink. The core material would then be encased in a molded shell that is dimpled.

Referring to FIG. 7, an illustrative method for fabricating a RFID golf ball is shown. As described above, a two-piece golf ball includes a core material surrounded by a shell. The core material is fabricated from a slug. The slug may be a processed rubber that has been extruded and cut into a cylinder shape that is slightly larger than the size of a golf ball. The shell material is often rubber or a thermoplastic resin. The method begins at block 702 where the extruded and cut slugs are placed in a tray such as that shown at 612 in FIG. 6C. Lower tray 612 is driven toward an upper tray such as that shown at 608. As the trays are forced together, the slugs are molded and baked into sphere-shaped cores, as indicated at block 704. At block 706, the cores are split in half, illustrated at FIGS. 6A-6B. At block 708, a RFID tag is sandwiched between the two halves of the split core, as illustrated at FIG. 6B. At block 710, for each core, the assembly comprising a lower core half and an upper core half with a RFID sandwiched between the halves is inserted into a spherical core mold as shown in FIG. 6C. At block 712, the cores are melted for a second time to bond the core halves together and trap the RFID tag within the core. At step 714, the cores containing RFID tags are placed in a shell mold that surrounds the core with shell material.

Referring now to FIGS. 8A-C, various states of manufacture of the illustrative golf ball having multiple RFID tags oriented such that the golf ball identification may be read regardless of the golf ball orientation relative to the RFID reader ("omnidirectional RFID golf ball") are shown. In FIG. 8A, a split core 800 is shown. A RFID tag 802 is shown positioned between the upper half 804 and the lower half 806 of the split core. RFID tag segments 808 and 810 are shown imprinted on the exteriors of core halves 804 and 806, respectively.

The conductive antenna tag segments 808 and 810 are disposed on the outside or exterior of the split core. The tag segments 808 and 810 could be adhesively coupled to the exterior of the core material, or an annealing process could be used to couple the antenna tag segments to the core material, or the tag segments 808 and 810 could be printed on to the exterior of the core material using a conductive ink. The core material would then be encased in a molded shell that is dimpled.

In FIG. 8B, the omnidirectional RFID golf ball 812 is shown in section after the upper half 804 of the core is joined to the lower half 806. As indicated in FIG. 8B, RFID tag segments 808 and 810 form a second RFID tag 814 that is oriented perpendicular to RFID tag 816 (also shown at 802 in FIG. 8A).

FIG. 8C illustrates the configuration of the core halves, RFID tag and spherical core mold trays in preparation for a second melt. The core halves are assembled such that RFID tag is sandwiched between the upper core half and the lower core half as shown at 818. Core assembly 818 is placed in a core mold comprising lower tray 820 and upper tray 822. In the mold, the upper half of the core is melted to the lower half of the core such that RFID tag 802 is encased within the spherical core.

Referring to FIG. 9A, an illustrative method for fabricating an omnidirectional RFID golf ball is shown. The method begins at block 902 where the extruded slugs are placed in a core mold tray such as that shown at 820 in FIG. 8C. Lower tray 820 is driven toward an upper tray such as that shown at 822. As the trays are forced together, the slugs are molded and baked into sphere-shaped cores, as indicated at block 904. At block 906, RFID tag segments are imprinted with conductive ink on the exteriors of the core halves as illustrated at FIG. 8B. At block 908, a RFID tag is sandwiched between the two halves of the split core, as illustrated at 818 in FIG. 8C. At block 910, for each core, the assembly comprising a lower core half and an upper core half with a RFID sandwiched between the halves is inserted into a spherical core mold as shown at 818. At block 912, the cores are melted for a second time to bond the core halves together and trap the RFID tag within the core. At step 914, the cores containing RFID tags are placed in a shell mold that surrounds the core with shell material.

Referring to FIGS. 9B and 9C, there is shown another illustrative omnidirectional RFID golf ball embodiment. In FIG. 9B, a top view of the core 916 and RFID tag 918 on the surface of the core's sphere is shown. In FIG. 9C, a side view of the RFID tag 918 is shown on the spherical surface of the core 916. In this embodiment, the RFID golf ball that includes a RFID tag fixedly coupled to the surface of a spherical golf ball core corresponding to the RFID golf ball, wherein the RFID tag is disposed between the spherical golf ball core and a spherical golf ball shell.

In the illustrative embodiment, the RFID tag includes an omnidirectional antenna that operates in the ultra-high-frequency (UHF) range. Additionally, the illustrative RFID tag can be encapsulated in a flexible substrate that is disposed between the spherical golf ball core and a spherical golf ball shell.

By way of example and not of limitation, the illustrative RFID tag 918 operates at the 860 MHz-960 MHz and the size of the internal chip is 0.2 mm by 0.2 mm. The illustrative flexible substrate may be composed of PVC, Teslin, urethane or any such flexible material.

Referring to FIGS. 9D and 9E there is shown various states for manufacturing the omnidirectional RFID golf ball. In FIG. 9D, the RFID tags 920 are placed into the spherical molds before the spherical core is placed into the mold for a subsequent melt that fixedly couples the RFID tag to the surface of the spherical core. Alternatively, in FIG. 9E the RFID tags 922 are placed on the exterior of the spherical core before the spherical core is placed into the mold.

FIG. 9F shown an illustrative method for manufacturing the omnidirectional RFID golf ball presented in FIGS. 9B-9E. The method begins at block 932 where the extruded slugs are placed in a core mold tray. At block 934 the slugs are molded and baked into sphere-shaped cores. At block 906 shown in FIG. 9A, a determination is made whether to place the RFID tag 920 into the spherical molds 936 or to place the RFID tags on the exterior surface of the spherical cores 938. At block 940, for spherical cores with the RFID tags are inserted into a spherical core mold as shown at 9D and 9E. At block 942, the cores are melted for a second time to bond the RFID tags with the exterior of the spherical cores. At step 944, a first flexible elastomeric layer may be applied; this flexible material may be applies to further protect the RFID tag. At decision diamond 946, a decision to add another flexible layer is made and the next flexible material layer is added at block 948. Finally, at block 950 a shell layer is applied that surrounds the core with the RFID tag on the exterior of core's spherical surface.

Referring to FIG. 10A, an illustrative issue area RFID reader 1000 for a golf ball 1002 containing a two-dimensional RFID tag ("2D RFID golf ball") is shown. The RFID reader may be a component of a golf ball dispenser such as the dispenser shown at FIG. 3A. Alternatively, the RFID reader may be a standalone unit. A bucket 1004 contains a plurality of 2D RFID golf balls such as the one shown at 1002. A RFID reader having a two-dimensional antenna array ("2D RFID reader") is used to simultaneously identify the plurality of 2D RFID golf balls located in the bucket. The 2D RFID reader includes a first antenna located in vertical panel 1006 and a second antenna located in a platform 1008 on which the bucket 1004 rests.

Referring now to FIG. 10B, an illustrative issue area RFID reader 1050 for an omnidirectional RFID golf ball ("3D RFID golf ball") 1052 is shown. The 3D RFID golf ball is illustrated at FIGS. 8A-8B. A bucket 1054 contains a plurality of 3D RFID golf balls such as the one shown at 1052. Advantageously, a RFID reader having a single antenna ("1D RFID reader") may be used to simultaneously identify the plurality of 3D RFID golf balls located in the bucket (as opposed to the 2D RFID golf ball which requires a 2D RFID reader). The 1D RFID reader is located in platform 1056 on which the bucket 1054 rests. Alternatively, the 1D RFID reader may be located in a vertical panel.

Referring to FIG. 11A, an illustrative tee area RFID reader 1100 for a 2D RFID golf ball 1102 is shown. A 2D RFID reader is used to identify the 2D RFID golf ball before it is hit. The 2D RFID reader includes a first antenna located in vertical panel 1106 and a second antenna located in a platform 1108 below the 2D RFID golf ball when it is on a tee.

Referring now to FIG. 11B, an illustrative tee area RFID reader 1150 for a 3D RFID golf ball 1152 is shown. A 1D RFID reader is used to identify the 3D RFID golf ball before it is hit. The 1D RFID reader is located in platform 1154 below the 3D RFID golf ball when it is on a tee. Alternatively, the 1D RFID reader may be located in a vertical panel.

Referring to FIG. 12A, an illustrative movable target 1200 having a plurality of nested enclosed boundary capture components is shown. For illustrative purposes, the enclosed boundary capture components are presented as funnels, in which the target includes an exterior funnel 1202, one or more inner funnels 1204, and an innermost funnel 1206. Each illustrative funnel has a wide perimeter and a narrow perimeter. A ball landing within the wide perimeter subsequently travels to the narrow perimeter via a guide 1208. In some embodiments, a ball landing within the funnel is directed by the funnel to a receiver proximate to the narrow opening of the funnel. For example, funnel 1202 directs a ball landing within the opening indicated at 1202 via guide 1208 to ball receiver 1210. The funnels are mounted on frame 1212. The frame is shown comprising legs 1214 mounted to ring 1216. However, it will be recognized that other frame configurations may be used to support the nested funnels. The frame is shown mounted on caster wheels 1218. In some embodiments, the target does not have wheels. The target may incorporate non-wheel elements that enable the target to be moved, such as a lightweight frame, sleds mounted to the underside of the frame, or a frame configured to make the target transportable by forklift. In one embodiment, the target includes a GPS unit 1220 comprising a GPS receiver and a GPS network communications module. The GPS receiver is used to determine the location of the movable target relative to the driving range. The GPS unit transmits to server 504 a signal comprising the location detected by the GPS receiver and an identification associated with the movable target.

The nested funnels of the target may be oriented such that the funnel openings are parallel to the ground, as shown in FIG. 12B, or such that the funnel openings are not parallel to the ground, as shown in FIG. 12A. In some embodiments, the orientation of the funnel openings may be adjustable, for example, by adjusting the length of one or more of the legs of the frame.

Referring to FIG. 12B, an illustrative movable target 1250 having RFID-enabled ball receivers is shown. A RFID-enabled ball receiver 1252 includes a RFID unit and a ball collector 1256. The RFID unit includes a movable target RFID reader 1254 and a movable target network communications module. In some embodiments, a single movable target network communications module is associated with all RFID readers associated with a target. The RFID unit may be coupled to the target frame 1212. In some embodiments, the RFID unit is physically separate from the target and rests on the ground. A RFID golf ball entering one of the target funnels, such as funnel 1202, is channeled to the corresponding receiver, i.e. receiver 1210, which in some embodiments is a RFID-enabled ball receiver 1252. The identification associated with the RFID golf ball is detected by the RFID reader as the RFID golf ball passes through the RFID unit. The RFID unit transmits to server 504 a signal comprising the identification of the RFID golf ball and an identification associated with the funnel in which the ball landed. The ball is then deposited in the ball collector.

In some embodiments, one or more network communications modules associated with a RFID unit may be communicatively coupled to the GPS unit. In lieu of a GPS network communications module, the GPS unit may share a network communications module with one or more RFID units. The RFID unit network communications module may send to server 504 a signal comprising the identification of the ball using a wireless network (not shown), the identification of the funnel in which the ball landed, and the location of the target. The signal may include additional information such as the time at which the ball landed.

Referring to FIG. 13A, an illustrative ball separation system 1300 is shown. In some embodiments, the ball separation system is used to separate RFID golf balls, such as the ball indicated at 1302, from golf balls lacking RFID tags ("non-RFID golf ball"), such as the ball indicated at 1304. The ball separation system is coupled to the guide 1306 of a funnel, such as guide 1208 shown in FIG. 12A. A ball falls from guide 1306 into column 1308 and is temporarily trapped between first separation component 1310 and second separation component 1312.

The first separation component 1310 and the second separation component 1320 function as golf ball separators. By way of example and not of limitation, the first and second separation components 1310 and 1312 may be embodied as partial discs as shown in FIG. 13A, as a spoke arrangement, as a turnstile, or any other such golf ball separators.

For example, a ball falls from guide 1306 into a ball isolation system within column 1308. The ball isolation system may comprise a first partial disc 1310 and a second partial disc 1312. The first partial disc rotates such that a single golf ball enters the ball isolation system. The second partial disc is rotated such that the ball cannot exit the ball isolation system. The first and partial discs may be controlled by ball separation control system 1314 or by an independent control system. In some embodiments, the ball isolation system comprises a single partial disc (not shown). The golf ball is temporarily trapped within the opening in the single partial disc.

While the ball is trapped, ball separation control system 1314 determines whether the ball is a RFID golf ball or a non-RFID golf ball using RFID reader 1316. RFID reader 1316 may be a RFID reader of a RFID unit, such as RFID reader 1254 of RFID unit 1252 indicated in FIG. 12B. In some embodiments, the ball isolation system comprises a helical ramp (not shown) configured such that the RFID tag embedded in the RFID golf ball rotates at least 180 degree relative to an antenna of the RFID reader as the golf ball rolls down the ramp. The rotation of the golf ball ensures that the antenna will be able to read a 2D RFID golf ball. Because the RFID antenna may not be able to read a RFID tag within a 2D RFID golf ball when the RFID tag is oriented substantially parallel to the orientation of the waves emitted by the antenna, the rotation of the golf ball continually changes the orientation of the golf ball such that the RFID reader is able to obtain a reading.

If the ball is a RFID golf ball, control system 1314 instructs actuator 1318 to position ball separator gate 1320 such that the RFID golf ball is directed to RFID ball collector 1322. Referring to FIG. 13B, the area of ball separation system indicated in box 1324 is shown with ball separator gate 1320 in a second position that routes non-RFID golf balls into a collection area for non-RFID golf balls. When a non-RFID golf ball is trapped between ball separators 1310 and 1312, the control system 1314 uses RF Reader 1316 to determine that the ball is a non-RFID golf ball. The control system then instructs motor 1318 to position ball separator gate 1320 such that the non-RFID golf ball is directed to a collection area for non-RFID golf balls as indicated in FIG. 13B. The non-RFID golf balls may be deposited on the ground or the non-RFID golf balls may be collected in a non-RFID golf ball collector vessel. It will be recognized that alternative mechanical or electrical systems may be used to route the balls according to the RFID status of the ball.

Referring to FIG. 14, an illustrative method 1400 for scoring driving range play using RFID-enabled movable targets is shown. The method begins at block 1402, at which the RFID golf ball is put into play by a player hitting the ball on to the driving range. In some embodiments, the RFID golf ball has been associated with a player identification prior to being put into play, for example when an issuing area RFID reader identifies balls deposited in a bucket as described in reference to FIGS. 4 and 5. The method proceeds to decision diamond 1404 where it is determined whether the RFID golf ball has entered a target funnel, such a target funnel shown in FIGS. 12A-B. As indicated at block 1406, if the RFID golf ball entered a target funnel, the RFID golf ball is identified by a reader such as reader 1254 shown in FIG. 12B. The method proceeds to block 1408, at which the ball ID and associated data are sent to server 504, as described in reference to FIG. 5. The associated data may include, for example, an identification of the target, a location of the target as determined by a GPS receiver associated with the target, and a time at which the ball landed in the target. The method proceeds to optional block 1410, at which ball data may be used by the server to calculate data corresponding to a particular hit. For example, the speed, distance, normalized distance, accuracy, point value, and cost (e.g., on a driving ranged used for gaming) associated with a hit may be determined. At optional block 1412, the data generated by the server for a particular hit may be made available for display to the player. For example, the player may be able to view the statistics on a display located at the driving range or on a handset or personal computer having an application configured to communicate with server 504. At decision diamond 1414, it is determined whether play has ended. For example, it may be determined that play has ended if all of the RFID golf balls associated with a player have passed the second reader (and thus were hit from the golf mat onto the driving range). If play has ended, the method proceeds to optional block 1416, at which the server determines that all RFID golf balls that passed the second reader but were not read at a target missed all targets, and are thus scored as "miss." At optional step 1418, the server calculates statistical or summary information applicable to all balls played in the session. For example, statistical or summary information pertaining to distance, speed, accuracy, point value, cost, and missed balls may be calculated by the server. At optional block 1420, the statistics or summary information is made available for display to the player, for example, on a display at the driving range, a handset, or a personal computer.

It is to be understood that the detailed description of illustrative embodiments are provided for illustrative purposes. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A radio-frequency identification (RFID) golf ball range target system comprising:

a plurality of golf hitting booths;

a plurality of RFID golf balls, wherein each RFID golf ball includes a RFID tag fixedly coupled to the surface of a spherical golf ball core and the RFID tag is disposed between the spherical golf ball core and a spherical golf ball shell;

each RFID golf ball including an omnidirectional antenna associated with the RFID tag that operates in the ultra-high-frequency (UHF) range;

each RFID golf ball including a flexible substrate that encapsulates the RFID tag, wherein the flexible substrate is disposed between the spherical golf ball core and a spherical golf ball shell, wherein the flexible substrate includes an elastomeric material that encapsulates the RFID tag that includes an RFID antenna and an RFID chip;

each RFID golf ball including a unique RFID golf ball identifier;

a scanner disposed in each hitting booth that scans an electronic device associated with a particular player so that the electronic device includes a player ID;

a client computer disposed in each hitting booth that includes a touch screen display that presents a plurality of player information associated with the player ID;

a golf ball dispenser disposed in each hitting booth that houses a plurality of RFID golf balls;

an RFID reader disposed within the golf hitting booth and associated with the golf dispenser, the RFID reader that reads each RFID golf ball associated with the player ID, the RFID reader communicatively coupled to a network communications module;

a target area having a known geographic location that reads each golf ball that lands in a capture area and identifies each RFID golf ball that is associated with the player ID;

a game of skill associated with hitting the RFID golf ball at the target area and awarding a skill based prize for hitting the golf ball at the target area; and at least one game of chance that awards a prize according to a random outcome, wherein the game of chance prize is awarded only when the golf ball misses the target area.

2. The RFID golf ball range target system of claim 1 wherein the target area includes, an enclosed boundary capture component that receives at least one RFID golf ball in a capture area;

a target RFID reader associated with the capture area that reads the RFID golf ball; and a target network communications module that communicates a plurality of reads associated with the target RFID reader reading a plurality of RFID golf balls.

3. The RFID golf ball range target system of claim 1 further comprising a game selection module presented on the client computer, wherein the game selection module enables the player to select from a plurality of different games.

4. The RFID golf ball range target system of claim 3 wherein the game selection module includes at least one game of skill, in which an award is provided when the RFID golf ball associated with the player ID is read by the target RFID reader that is associated with the capture area.

5. The RFID golf ball range target system of claim 3 wherein game of chance that awards a prize according to a random outcome and a paytable further comprises, a game session for the game of chance that is initiated when the RFID golf ball associated with the player ID is read by the target RFID reader.

6. The RFID golf ball range target system of claim 1 further comprising a server communicatively coupled to the scanner, the client computer and the issuing area network communications module, wherein the server further comprises a database that stores data that includes an association between a plurality of RFID golf balls and the player ID and the geographic location of the target.

7. A radio-frequency identification (RFID) golf ball range target system comprising:

a RFID golf ball that includes a RFID tag fixedly coupled to the surface of a spherical golf ball core corresponding to the RFID golf ball, wherein the RFID tag is disposed between the spherical golf ball core and a spherical golf ball shell, wherein a flexible substrate includes an elastomeric material encapsulates the RFID tag that includes an RFID antenna and an RFID chip;

a unique RFID golf ball identifier associated with the RFID golf ball; a golf driving range booth;

a scanner disposed within the golf driving range booth, wherein the scanner scans an electronic device associated with a particular player identification (ID);

a client computer disposed with the golf driving range booth that includes a touch screen display presents a plurality of player information, wherein the electronic device includes a player ID;

a golf ball dispenser houses a plurality of RFID golf balls, wherein the golf ball dispenser in disposed within the golf driving range booth;

an RFID reader disposed within the golf driving range booth and associated with the golf dispenser, the RFID reader reads a plurality of RFID golf balls that are associated with the player ID, the RFID reader communicatively coupled to an issuing area network communications module; and a target having a known geographic location, wherein the target includes, an enclosed boundary capture component receives at least one RFID golf ball in a capture area, a target RFID reader associated with the capture area that reads the RFID golf ball, and a target network communications module that communicates a plurality of reads associated with the target RFID reader reading a plurality of RFID golf balls;

a game of skill associated with hitting the RFID golf ball at the target area and awarding a skill based prize for hitting the golf ball at the target area; and at least one game of chance that awards a prize according to a random outcome, wherein the game of chance prize is awarded only when the golf ball misses the target area.

8. The RFID golf ball range target system of claim 7 wherein the RFID tag further comprises an omnidirectional antenna that operates in the ultra-high-frequency (UHF) range.

9. The RFID golf ball range target system of claim 7 wherein the RFID tag flexible substrate includes Teslin.

10. The RFID golf ball range target system of claim 7 wherein the game of skill provides an award when the RFID golf ball associated with the player ID is read by the target RFID reader that is associated with the capture area.

11. The RFID golf ball range target system of claim 7 wherein the first scanner includes a Near Field Communications (NFC) reader and the electronic device includes an NFC enabled electronic device.

12. The RFID golf ball range target system of claim 7 wherein the RFID flexible substrate includes urethane.

13. The RFID golf ball range target system of claim 7 wherein the client computer includes a touch screen display and further comprises a second display that also presents the plurality of player information associated with the player ID.

14. The RFID golf ball range target system of claim 7 further comprising a server communicatively coupled to the issuing area network communications module, the target area network communications module, the scanner, the client computer and the game selection module, wherein the server further comprises a database that stores data that includes an association between a plurality of RFID golf balls and the player ID, a RFID golf ball identification from the target RFID reader, and the geographic location of the target.

15. A method for operating a radio-frequency identification (RFID) golf ball range target system, the method comprising:

scanning an electronic device having a player ID at a golf hitting booth that is associated with a particular player with a scanner;

presenting a plurality of player information associated with a player ID to a client computer located in the golf hitting booth;

dispensing a plurality of RFID golf balls, wherein each RFID golf ball includes a flexible substrate that encapsulates an RFID tag, the flexible substrate disposed between a spherical golf ball core and a spherical golf ball shell, wherein the flexible substrate includes an elastomeric material configured to encapsulate the RFID tag that includes an RFID antenna and an RFID chip;

enabling an RFID reader to read each RFID golf ball that includes the RFID tag fixedly coupled to the surface of a spherical golf ball core, wherein the RFID tag includes an omnidirectional tag disposed between the spherical golf ball core and a spherical golf ball shell that are associated with the player ID, the RFID reader communicatively coupled to an issuing area network communications module;

receiving the RFID golf ball at a target having a known geographic location, wherein the target includes an enclosed boundary capture component configured to receive at least one RFID golf ball in a capture area;

enabling a target RFID reader associated with the capture area to read the RFID golf ball;

communicating a plurality of RFID golf ball data obtained from the target RFID reader via a target network communications module;

initiating a game of skill that is associated with hitting the RFID golf ball at the target area and awarding a skill based prize for hitting the golf ball at the target area; and initiating at least one game of chance that awards a prize according to a random outcome, wherein the game of chance prize is awarded only when the golf ball misses the target area.

16. The method for operating the RFID golf ball range target system of claim 15 wherein the game of skill provides an award when the RFID golf ball associated with the player ID is read by the target RFID reader that is associated with the capture area.

17. The method for operating the RFID golf ball range target system of claim 15 wherein the RFID tag flexible substrate includes Teslin.

18. The method for operating the RFID golf ball range target system of claim 15 wherein the client computer includes a touch screen display and further comprises a second display that also presents the plurality of player information associated with the player ID.

19. The method for operating the RFID golf ball range target system of claim 15 further comprising enabling a server to be communicatively coupled to the issuing area network communications module, the target area network communications module, the scanner, and the client computer, wherein the server further comprises a database configured to store data that includes an association between a plurality of RFID golf balls and the player ID, a RFID golf ball identification from the target RFID reader, and the geographic location of the target.

* * * * *